United States Patent [19]

Ulch

[11] 4,299,326

[45] Nov. 10, 1981

[54] WEIGHT SORTING MEMORY CIRCUIT

[75] Inventor: Bryan D. Ulch, Saugus, Calif.

[73] Assignee: FMC Corporation, Chicago, Ill.

[21] Appl. No.: 91,322

[22] Filed: Nov. 5, 1979

[51] Int. Cl.[3] ..... B07C 5/28

[52] U.S. Cl. ..... 209/564; 209/592; 235/92 WT

[58] Field of Search ..... 209/563–566, 209/592–595; 235/92 MT, 92 WT

[56] References Cited

U.S. PATENT DOCUMENTS

| | | | |
|---|---|---|---|
| Re. 29,031 | 11/1976 | Irving et al. . | |
| 2,601,915 | 7/1952 | Eggleston et al. . | |
| 2,666,536 | 1/1954 | Smith . | |
| 2,895,274 | 7/1959 | Mumma . | |
| 3,259,240 | 7/1966 | Schneider | 209/565 X |
| 3,460,673 | 8/1969 | Sanner | 209/565 |
| 3,627,127 | 12/1971 | Whiteford . | |
| 3,640,384 | 2/1972 | Del Rosso . | |
| 3,898,435 | 8/1975 | Pritchard et al. | 209/565 X |
| 4,105,123 | 8/1978 | Irving et al. . | |
| 4,106,628 | 8/1978 | Warkentin et al. . | |

FOREIGN PATENT DOCUMENTS

| | | |
|---|---|---|
| 2157137 | 6/1973 | France . |

*Primary Examiner*—Joseph J. Rolla
*Attorney, Agent, or Firm*—H. M. Stanley

[57] ABSTRACT

A memory circuit is provided for use in conjunction with a conveying apparatus having a number of discharge or drop points at which articles may be discharged so that the articles may be sorted according to weight. A micro-processor is also provided which receives a synchronizing signal from the drive for the sorting conveyor as well as measurement signals which are indicative of the weights being measured. The micro-processor classifies the measured weight in accordance with a classification program. The classified weights are inserted into memory locations within memory segments assigned to specific ones of the conveyor drop points. Each memory segment assigned to a conveyor drop point has a predetermined number of memory locations therein corresponding to a predetermined number of conveyor increments extending from the point on the conveyor at which the weight classification of the article takes place to the drop point. The distance from the classification point on the conveyor to each drop point is measured in terms of conveyor length increments and monitored during each circuit of the endless conveyor belt. If the length in conveyor increments from a reference position to a particular drop point increases or decreases, the memory segment corresponding thereto is changed by adding or subtracting one or more memory locations in accordance with the increase or decrease.

9 Claims, 20 Drawing Figures

FIG_16
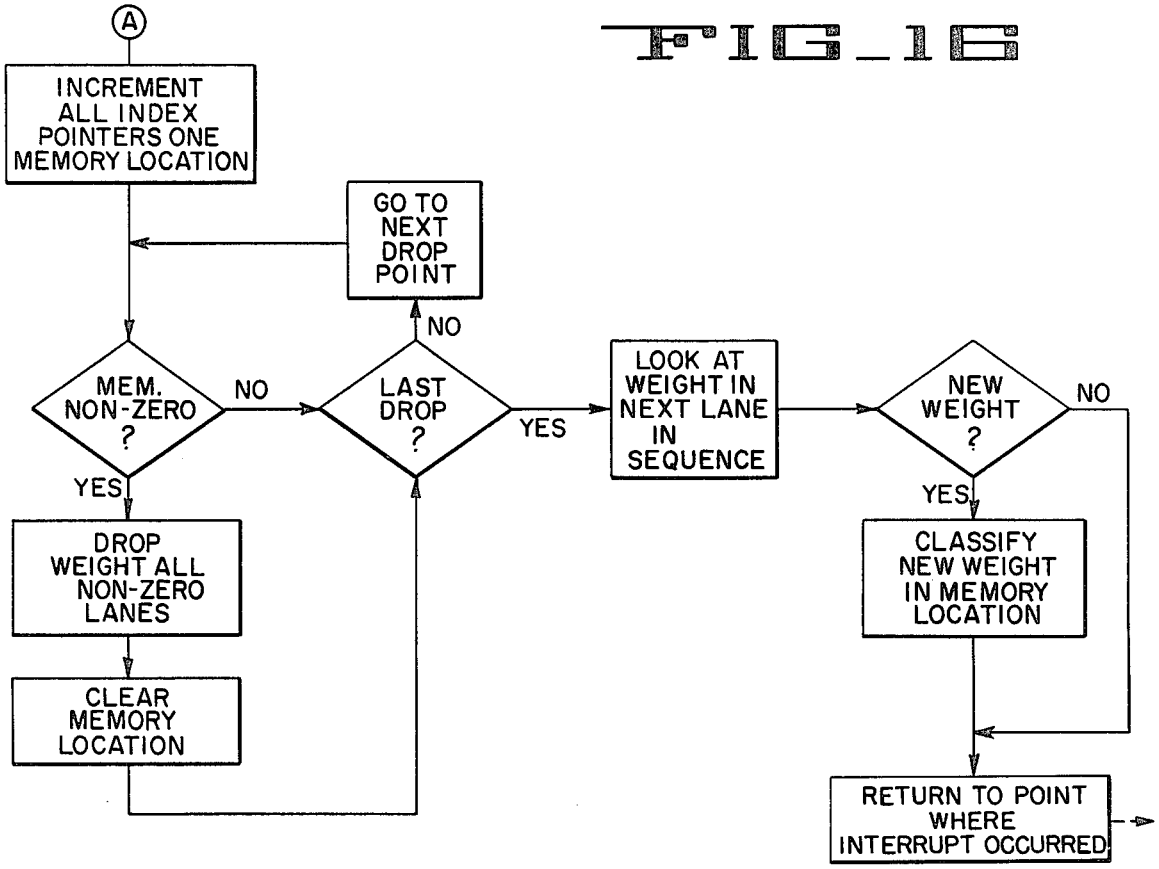
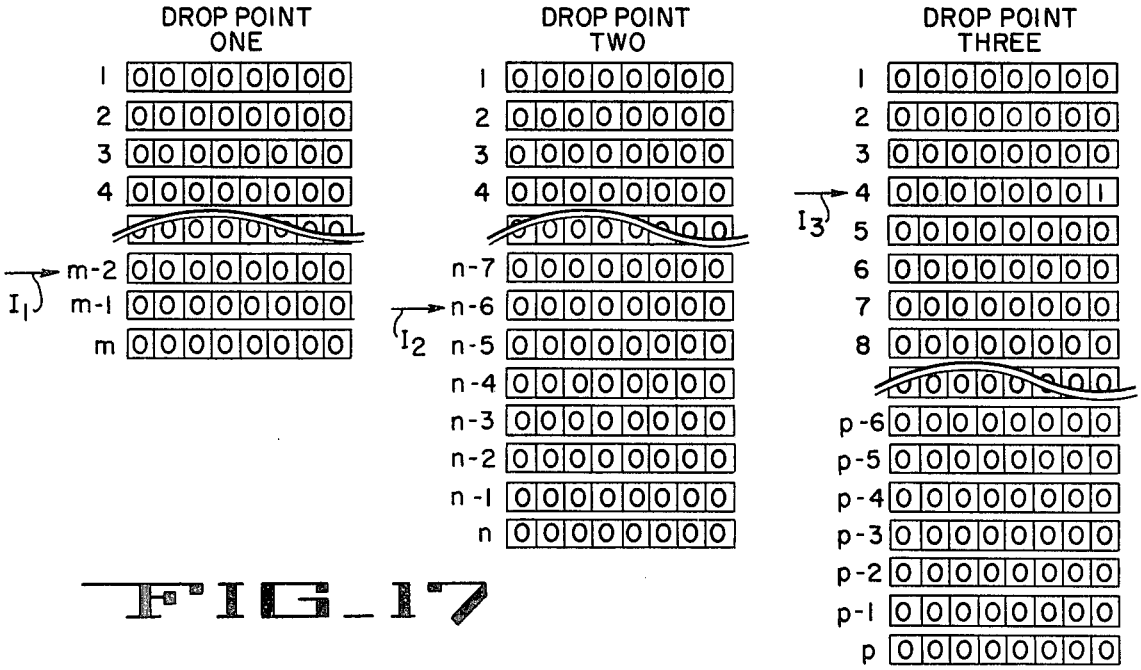
FIG_17
FIG_18
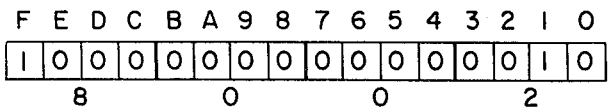

WEIGHT SORTING MEMORY CIRCUIT

BACKGROUND OF THE INVENTION

1. Field of the Invention

The invention disclosed herein relates to apparatus for sorting articles presented in a serial array in accordance with a predetermined physical characteristic of the articles, and more particularly, it relates to such apparatus for performing sorting in an accurate and rapid manner on a large number of such articles while retaining the physical characteristic data in predetermined storage locations and thereafter retrieving such data to perform the sorting for each individual article.

2. Description of the Prior Art

The limitations on a system for sorting articles from a serial array of such articles presented to the system is generally dictated by the size of the memory associated with the system. Data relating to the sorting operation must be stored and retrieved before it is ultimately utilized in discharging the articles from a transporting or conveying portion of the system. Thus, the number of articles which may be handled in a given period of time and the number of sorting ranges is dictated by the size of the memory in the system.

There are many things to remember in a more complex sorting system and very little time to put the representative data into the system memory. For a particular sorting task when a central processing unit is used to do all parts of the job, the job takes a specific amount of processing time. One of the major design questions is whether the central processing unit can accomplish all of the parts of the job in the time allotted. When the speed requirement for sorting approaches the capability limit of the sorting system, the alternatives are presented of either obtaining a higher speed central processing unit and associated circuit components or running the machine slower. The former approach provides a higher level of system expense together with a higher probability of computing errors due to the greater complexity of the circuitry while the latter alternative clearly limits the system's throughput, which is often unacceptable.

A number of systems are currently known which measure certain characteristics of articles presented in a serial array and which store the measurement data so that an operation may be performed by the system at a later point in time when the article has been transported to a predetermined location. One such system is disclosed in French Pat. No. 2,157,137 issued to Tissmetal which describes a system for automatic loading and unloading of a continuous transporter. A transporter or conveyor is divided into a number of adjacent object sites, each of which are subdivided into a specific number of bands. A number of loading stations are positioned at the upstream end of the conveyor and a number of unloading stations are positioned toward the downstream portion of the conveyor. A sensor is provided which detects the passage of each band in each object site as the conveyor moves thereby and which generates pulses connected to a counter. The counter continuously counts up to a number corresponding to the number of bands in each of the object sites and returns to repeat the count from the first band of the ensuing object site. A central memory has as many memory cases as there are object sites. Each memory case is capable of holding the address of an object. When an object is awaiting loading onto the conveyor at a loading station, the object's destination is written into a memory at the loading station. When a loading site which is free of other objects presents itself in front of the loading station, the object is loaded onto the conveyor and the unloading address is written from the loading station memory into the central memory. The unloading address is displaced by one memory case in the central memory each time the conveyor position sensor detects that another entire object site has passed by the sensor. In this fashion, the central memory becomes an image of the conveyor. A code number is associated with each of the unloading stations and a logic device continually compares the code number with the address of the object site which currently presents itself in front of that unloading station. When the object reaches the designated unloading station, the code number and the address of the object will be in agreement and the object will be transferred off of the conveyor at that station. The number of bands into which each object site is divided will dictate the control precision for both conveyor loading and unloading.

U.S. Pat. No. 2,601,915 issued to Eggleston et al discloses an endless belt conveyor for transporting boxes from any one of the number of vertically displaced floors to others of the floors as selected by switches at the floors where the boxes are loaded onto the conveyor. When a box is to be loaded on the conveyor at one of the floor levels, the box is deposited in a loading position and an operator manually actuates a switch which designates the unloading floor. A series of switches including a switch actuated by the weight of the box at the loading station causes loading arms to position the box onto an empty carriage on the conveyor and at the same time a switch actuating pin is set on a timing wheel which rotates in synchronism with the conveyor. When the conveyor reaches the designated unloading station, the pin on the timing wheel actuates another switch which in series with an unloading switch actuated by the arriving carriage completes a circuit for energizing a mechanism which unloads the box at the unloading station. Cams are provided for resetting the switch actuating pins on the timing wheels to their non-actuating positions at the end of each cycle of operation of the timing wheel.

In U.S. Pat. No. 2,666,536 issued to R. L. Smith a sorting control for wood veneer cut to different widths is disclosed. The Smith sorter includes a number of manually set index fingers attached to the conveyor carrying the veneer which are operated by a skilled observer of the passing sheet of veneer to indicate certain positions on the sheet at which transverse cuts need to be made for the purpose of removing flaws in the veneer sheet. A stepper switch is energized and advanced by each of the index pins when they are in the unset position. Thus, the stepper switch is advanced synchronously with the passage of the conveyor. A set index pin not only advances the stepper switch but also closes another switch in series with the stepper switch so that a veneer width sorting circuit is completed and an appropriate mechanism is set into motion which deposits the cut piece of veneer in a bin receiving veneer widths corresponding to the set pin. The stepper switch is also reset by the set index pins. Thus, as long as the index pins are allowed to remain in the inoperative or unset position the stepper switch will be advanced stepwise by the passage of unset index pins. Therefore, the discharge mechanisms for the wider cut veneer widths are associated with the higher stepwise positions of the switch. When a width of veneer is so small as to be unusable, such as when index pins are set which are close together, the cut piece is not engaged by any of the sorting mechanisms but is allowed to tumble off the end of the conveyor into a scrap receiver.

U.S. Pat. No. 3,898,435 issued to Pritchard et al discloses a memory device for use with an egg grading machine wherein a single lane conveyor carries eggs in spaced configuration past a series of packing stations where eggs are to be delivered into pocketed containers in accordance with predetermined weight grades. Signals from weight transducers which indicate the egg weights are transmitted to circuitry wherein they are coded and transferred into a primary electronic memory unit in a predetermined sequence. The eggs are then discharged from the scales into individual egg carriers or buckets on an egg conveyor which transports them toward the series of packing stations. The eggs are discharged at each packing station so that each egg is placed in one of six longitudinally spaced positions in the pocketed containers. The memory device which receives the egg weight data is a serial shift register within which weight data is stored and shifted in response to pulse signals provided by a clock. The shifting of data within the memory unit is independent of the movement of the eggs on the egg conveyor. Data is shifted through the register at a much faster rate than the rate of movement of the eggs along the conveyor path and the two rates are not related. The shifting of the data through the memory register is such that the conveyor in effect stands still during a complete cycle of data through the memory register. A register position counter is operated in conjunction with the memory register. Phase pulses are produced which are in synchronism with the movement of the egg conveyor. One phase pulse is transmitted to the register position counter for each movement of the conveyor which corresponds to the spacing between adjacent egg carrying buckets. Each phase pulse increases the count in the register position counter by one unit and therefore has the effect of shifting all the information in the memory register by one egg bucket length along the conveyor. New weight and grade information is taken into the memory register on the first clock pulse following a phase pulse. At the same time information is read out of the memory register and transmitted to logic circuits at the various packing stations. The logic circuits are configured to recognize data which requires egg dropping at a particular packing station.

In U.S. Pat. No. 2,895,274 issued to Mumma, a machine for grading eggs and delivering the graded eggs to predetermined discharge stations is disclosed. The eggs are initially manually graded for quality by operators who inspect the eggs and place them in predetermined quality racks in accordance with their inspection determinations. The quality inspected eggs are transferred from the quality racks to a conveyor which transports the eggs to a weighing mechanism which makes an egg weight determination. From the weighing mechanism, the eggs are transported to another conveyor which delivers them in serial array to predetermined ones of a series of discharge stations. The appropriate discharge station is determined by both the quality and the weight of each egg. The quality determination of the egg is recorded on a rotating belt in accordance with the rack on which it was placed. The belt moves in synchronism with the conveyor which delivers the eggs to the discharge stations. The weight determination for a given egg is recorded in the same sector of the rotating belt as the one in which the quality determination is recorded. The particular sector of the memory belt in which quality and weight information is recorded corresponds to a particular egg carrying bucket on the conveyor delivering the eggs to the discharge stations. The recordation is accomplished through switch actuation which occurs due to the manual placement of the eggs by the inspector and the automatic weighing operation performed by the weighing mechanism in the machine. The actuated switches energize circuitry which sets pins carried in the corresponding segment of the memory belt. The movement of the belt, in synchronism with the egg delivery conveyor, provides a current record of the quality, weight and position of the eggs. Once the quality and weight graded egg reaches its predetermined discharge station control of the egg at that particular discharge station is assumed by a secondary memory which operates to cause the eggs to be released from the distributing conveyor so that they are deposited in a succession of pockets in a grid-like carton beneath the conveyor. Both the primary and the secondary memories for the egg grading machine are dependent upon mechanically actuated switches which function to energize solenoids for setting memory pins in mechanical memory. The memory pins in turn function to actuate switches which energize solenoids providing for appropriate mechanical operations to discharge the eggs from the conveyor.

SUMMARY OF THE INVENTION

The invention described herein relates to apparatus and method for sorting articles in accordance with a measured physical characteristic wherein a conveyor is provided which transports the articles from a point where the characteristic is measured to one of a plurality of points downstream on the conveyor each of which corresponds to a predetermined measured value or range of measured values for the physical characteristic. The manner in which the articles are directed to the particular discharge point involves the use of a memory segment which is assigned to each one of the discharge points. Each memory segment has a predetermined number of memory locations therein wherein the number of such locations is dependent upon the distance along the conveyor from the measuring point to the corresponding discharge point. The memory locations operate to receive and store digital data which is indicative of the measured physical characteristics. Each memory segment is associated with means for indexing each of the memory locations in sequence and means for testing the data at each indexed memory location for the presence of stored data indicative of the measured physical characteristic. Further means is provided for synchronizing the means for indexing with the movement of the transporting conveyor. The circuit also includes means for outputting the stored data to the discharge point corresponding to the memory segment containing the indexed memory location when digital data indicative of the measured physical characteristic is found stored therein. In this fashion articles having predetermined physical characteristics are discharged from the conveyor at predetermined discharge stations.

According to another aspect of the present invention an apparatus is provided for sorting articles in accordance with ones of a plurality of value ranges for a particular physical characteristic wherein a conveyor provides transport for articles from a first point to a plurality of second points, and wherein the physical characteristic is measured at the first point and the articles are removed from the conveyor at one of the plurality of second points corresponding to a predetermined one of the value ranges.

The apparatus includes means located proximate to said first point for providing a reference output signal indicative of the position of said first point, and means located proximate to each of said plurality of second points for providing separate drop point output signals indicative of the position of separate ones of said plurality of second points.

The apparatus further includes means coupled to said reference and drop point output signals for storing the distance between said first point and separate ones of said second points in terms of conveyor length increments, and means for altering said stored distance when the conveyor changes length by more than a predetermined amount.

DESCRIPTION OF THE DRAWINGS

FIG. 8 is a block diagram of the electronic circuitry for the weight sizing apparatus of the present invention.

FIG. 9 is a block diagram of the interface circuit and one of the rotary solenoid driver portions of the circuitry of FIG. 8.

FIG. 13 is a fragmentary section taken along a vertical longitudinal plane through the weight sizing apparatus at one of the discharge stations and with subsequent discharging positions of one of the conveyor cups being shown in phantom lines.

FIG. 16 is a flow diagram of a subroutine associated with the discharge operations shown in FIG. 15.

FIG. 17 is a memory diagram for data storage and retrieval in the circuitry of the present invention.

FIG. 18 is a diagram of the form of some address information used in the circuitry of the present invention.

DESCRIPTION OF THE PREFERRED EMBODIMENT

Figure 1:
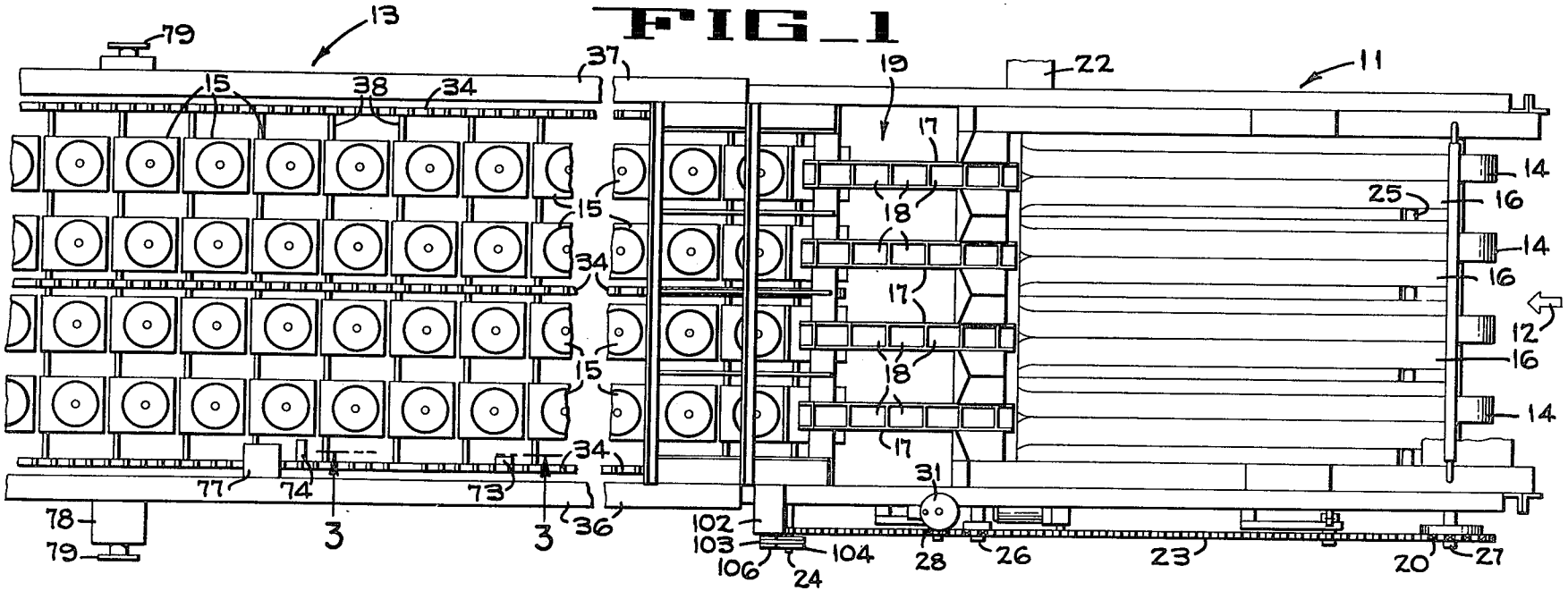
FIG. 1 is a partial plan view of the front end of the weight sizing apparatus of the present invention.

The front end and several downstream sections of a multichannel conveyor which transports articles, such as items of agricultural produce, from a source of supply to any one of a number of downstream discharge stations according to the weight of each individual item is shown in FIG. 1. The articles of produce will hereinafter be referred to as apples, it being understood that oranges, peaches, avocados, potatoes or other types of produce also may readily be sorted according to weight by the apparatus to be hereinafter described. A four lane singulator, shown generally at 11 (FIGS. 1 and 2), which is conventional in this field, is shown mounted at the front end of a four lane conveyor 13 with the singulator being disposed to receive apples from a source of supply such as a feed conveyor (not shown) moving in the direction of the arrow 12 (FIG. 1). The conveyor 13 includes four conveyor channels for purposes of this description although a lesser or greater number of conveyor channels may be accommodated by the invention disclosed herein.

The singulator 11 includes four parallel conveyors each including a long endless belt 14 and a short endless belt 16 with the upper runs of the belts being inclined to form a V-shape. The long and short belts are positioned adjacent to each other along one edge at the bottom of the V so that a cradle is formed to move the apples forwardly. One of the belts of each conveyor is driven to travel at a higher linear velocity than the other so that apples deposited thereon will be spun slightly to reduce the tendency for the apples to pile up. By the time the apples reach the left end (as seen in FIG. 1) of the conveyor belts they will be in substantially single file and in relatively close spacing depending upon the rate of feed from the source of supply. A short endless conveyor belt 17 is provided immediately downstream of each pair of belts 14, 16 to receive the apples in single file. Each belt 17 is comprised of a plurality of uniformly spaced cups 18. In the event that more than one apple is delivered to a cup 18 on conveyor 17, the extra apple will fall to one side or the other of the conveyor through an aperture 19. The thus dislodged apple falls upon a ramp 21 (FIG. 2) which directs it onto a retrieval conveyor 22 that reroutes the apple back to the source of supply. Apples carried in single file in the conveyors 17 are thereafter delivered to the channels in the multichannel conveyor 13 with which the conveyors 17 are aligned. Each of the channels in the conveyor 13 includes an endless array of apple receiving and holding cups 15 which pass under the discharge end of the associated conveyor 17 in a horizontally oriented carrying position as seen in FIG. 1.

Figure 2:
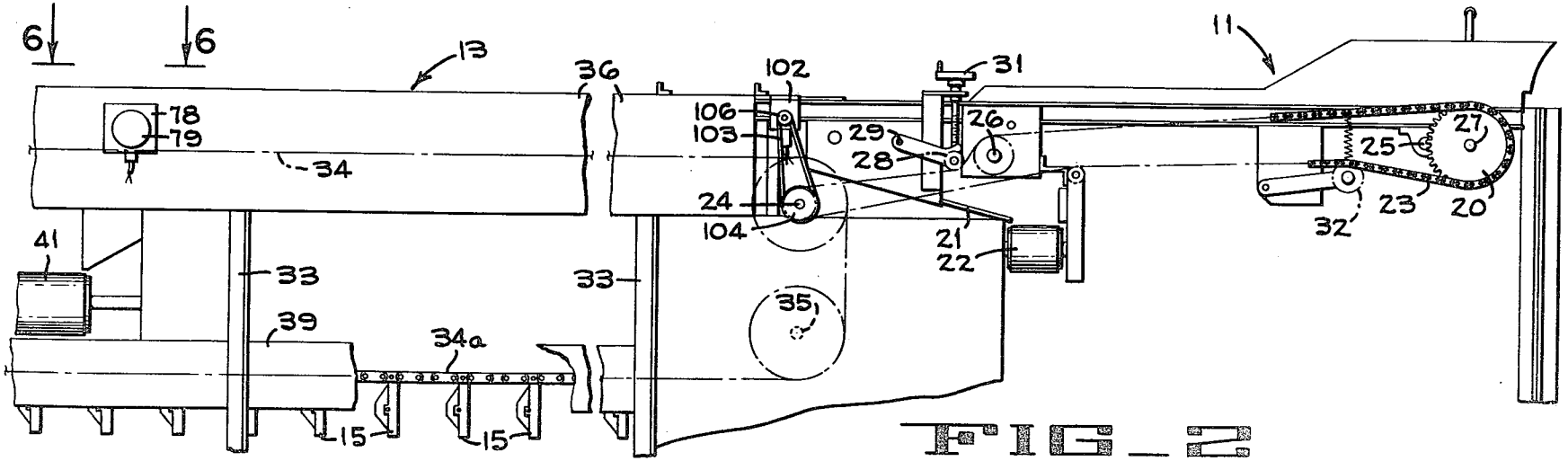
FIG. 2 is a fragmentary side elevation of the weight sizing apparatus of FIG. 1, with portions thereof being broken away.

The multichannel conveyor 13, the feed belts 14, 16, and the cup conveyors 17 are all driven from a common power source. In FIG. 2 an endless drive chain 23 is shown extending about an upper end shaft 24 for the multichannel conveyor 13, a drive shaft 26 for the cup conveyors 17 and a drive shaft 27 for the belts 14 and 16 in the singulator 11. The drive chain 23 is driven from the shaft 24 which, in turn, is driven by the motor (not shown) which provides the power for the multichannel conveyor 13. It should be noted that a sprocket 20 is mounted on the drive shaft 27 to provide the drive therefor through the drive chain 23. A separate, parallel drive shaft 25 drives the belts 16. The shaft 25 is driven by means of a sprocket (not shown) having a smaller diameter than that of sprocket 20 and being positioned on the opposite side of the singulator from the sprocket 20. The sprocket on shaft 25 is connected to shaft 27 through a drive chain (not shown) and a sprocket similar to sprocket 20 positioned on the opposite end of shaft 27 from sprocket 20. Thus, the belts 16 will move at a higher velocity than the belts 14, as mentioned hereinbefore.

An idler 28 (FIGS. 1 and 2) is mounted on an adjustable arm which is pivoted about a fixed pivot pin 29 and is vertically adjustable in position by means of a vertical screw adjust mechanism 31 to bear against the drive chain 23 with a greater or lesser force. Manipulation of the screw adjust mechanism 31 varies the effective length of the drive chain between the upper end shaft 24 on the multichannel conveyor 13 and the drive shaft 26 for the cup conveyors 17 so that the cups 18 may be adjusted to assume a proper phase relationship with the cups 15 of the multichannel conveyor. Slack in the drive chain 23 introduced or taken out by adjustment of the vertical screw adjust mechanism 31 is compensated for by a spring loaded idler 32 which bears against the underside of the drive chain (FIG. 2). Thus, an apple which is released from a cup 18 in the singulator will fall into a cup 15 in the conveyor 13 only when the cup 15 is in the proper position to receive the apple.

The weight sizing apparatus, including the conventional singulator 11, is supported on an underlying surface by means of a framework including left and right elongate side frame members 36 and 37, respectively, and support legs 33 as seen in FIG. 2. The serial arrays of spaced apple-carrying cups 15 are driven along each channel in the conveyor 13 by three endless drive chains 34 (FIGS. 1 and 2) arranged adjacent the side frame members 36, 37 and centrally therebetween. The drive chains are coupled to a drive motor (not shown) located at the downstream end of the apparatus. The apple-carrying cups 15 are coupled to one another across the four conveyor channels by means of a plurality of uniformly spaced rods 38, each of which extends through the leading ends of a set of four cups 15 and between the three conveyor drive chains 34 which support it. The conveyor drive chains are routed in a conventional manner around sprockets attached to a lower end shaft 35 (FIG. 2) and around sprockets attached to the upper end shaft 24.

The cups 15, after travelling in the direction of arrow 12 (FIG. 1) at the upper portion of the framework, are rerouted back to the front end of the conveyor on a lower conveyor reach 34*a* (FIG. 2) located behind a longitudinal structural member 39 as seen in FIG. 2. The cups 15 are shown in their discharge positions depending from the drive chains 34 on the return reach of the conveyor. A take-away conveyor 41 is shown (FIG. 2) disposed between the upper and lower reaches of the conveyor chains 34 at a discharge station downstream from the inlet end of the apparatus, and it will be appreciated that several other take-away conveyors are also present in the downstream (unshown) portion of the apparatus.

Figure 3:
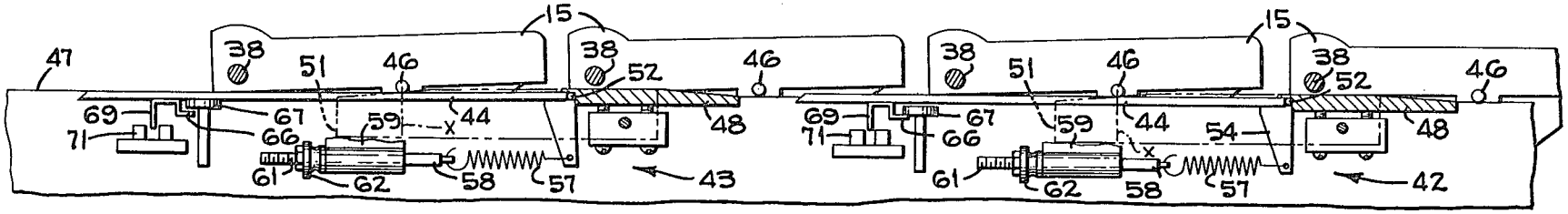
FIG. 3 is an enlarged section taken along the line 3—3 of FIG. 1 and showing the weight measuring scales.
Figure 5A:
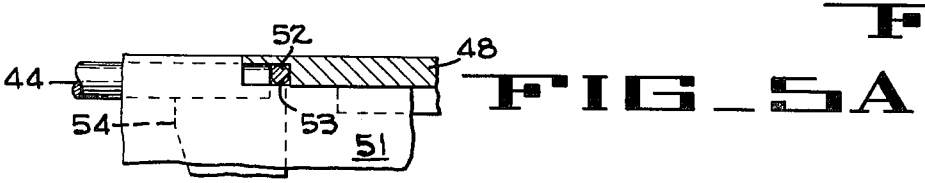
FIGS. 5A and 5B are enlarged sections taken along the lines 5A—5A and 5B—5B of FIG. 4, respectively.
Figure 4:
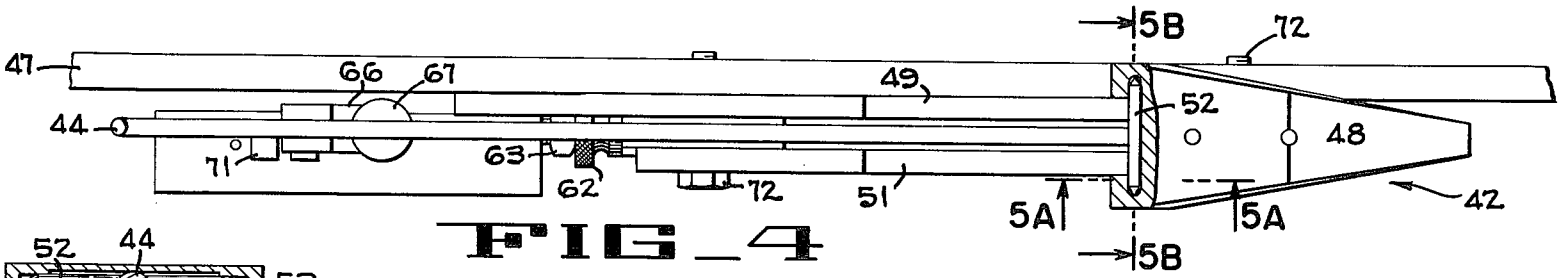
FIG. 4 is an enlarged plan view of one of the weight measuring scales of the sizing apparatus.
Figure 5B:
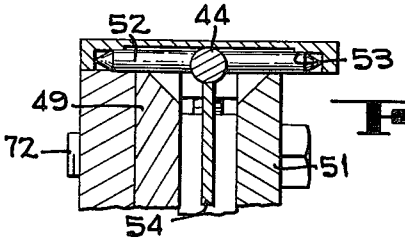
Figure 5:
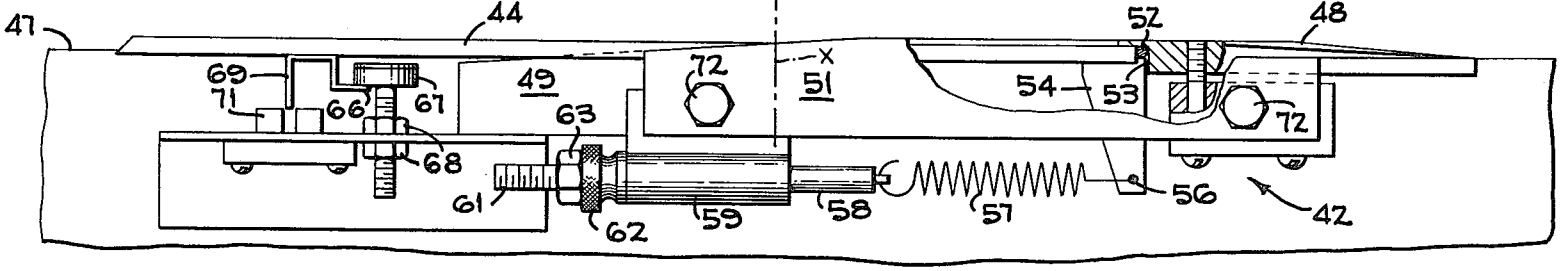
FIG. 5 is a side elevation of the weight measuring scale shown in FIG. 4.

Turning to FIG. 3, an enlarged view of a weighing station on one of the lanes of conveyor 13 is there shown. A continuous line of spaced cups 15 is provided for each of the four channels or lanes, as previously described. The weighing stations, one for each channel, are at the upstream end of the conveyor 13, and each channel contains two weighing scales. The two scales are provided for the purpose of separating the weighing operation into weight readings in two ranges, the heavier range being measured by a high range scale 42 at the upstream end of the weighing station and the lower range being measured by a low range scale 43 at the downstream end of the weighing station. Thus, all of the apples in one channel are passed over both the high and the low range scales 42 and 43 although only one scale will provide a reading in a manner to be described in detail hereinafter. Each of the high and low range scales is seen to include an elongate pivot arm 44 extending along the associated conveyor channel and being pivotable downwardly about the upstream end thereof. The cup carrying rod 38, being connected to the conveyor drive chains 34, serves to pull the cups 15 along in each of the four channels over the pivot arms 44 of the scales. A guide rail 47 (FIG. 4) is seen to extend along each conveyor channel, and the high and low range scales 42, 43 are mounted along a portion of each rail as shown in FIG. 3. The rail 47 maintains the cups 15 in their upright carrying positions by contacting a laterally projecting support pin 46 on each cup and supporting it in sliding relationship. It should be noted (FIG. 3) that at each weighing station a portion of the scale structures extend above the upper supporting level of the guide rail 47. Thus, a front end ramp 48 for each scale provides an up ramp which elevates the cup support pins 46 slightly above the level of the guide rail. The scale structure further includes a right side plate 49 and a left side plate 51 arranged on opposite sides of and laterally spaced from the pivot arm 44 (FIGS. 4 and 5). The upper support surfaces of the left and right side plates 51 and 49 are at the elevation of the ramp 48 at their upstream ends (FIG. 5) but have a descending contour toward the downstream end of the scale so that each support pin 46, after passing the ramp 48, is gradually lowered in elevation and thereby caused to contact the upper edge of the associated pivot arm 44 (at approximately the position marked by the line "x" in FIG. 3). The pivot arm 44 has a cross pivot member 52 (FIGS. 4, 5A and 5B) of cylindrical configuration fixed to the upstream end thereof. A transverse slot 53 (FIG. 5B) is formed in the ramp 48 so as to accept the cross pivot member 52. The right and left side plates 49 and 51 underlie the transverse slot 53 to capture the cross pivot member 52 so that it may undergo pivoting motion within the slot 53, as best seen by reference to FIGS. 5A and 5B. Pivot arm 44 also has a depending fin 54 attached to the pivot end thereof which fin has a hole 56 therethrough at its lower end. One end of a coil spring 57 is secured in the hole 56 and the other end is secured to a tension adjust rod 58. The rod 58 is loosely held in a housing 59 (FIG. 5) so that relative motion is permitted, and the opposite end of the tension adjust rod from that to which the spring is connected has threads 61 which accept a knurled adjust nut 62. Tension is imparted to the coil spring 57 by adjustment of the knurled nut 62 which shifts the position of the tension adjust rod 58 in the supporting housing 59. The knurled nut is locked in place after adjustment by threading a lock nut 63 tightly thereagainst. Consequently, pivot arm 44 is urged upwardly, as seen in FIG. 5, but will yield when a sufficient downwardly directed vertical force is exerted thereon.

A channel-shaped bracket member with a flange 66 is attached to the underside of the free end of each elongate pivot arm 44 with the flange being located to contact an adjustable stop member 67 (FIG. 5) to limit the upward movement of the pivot arm. The stop member 67 has a threaded shank so that the stop is adjustable to a selected vertical position and may thereafter be locked in such desired vertical position by tightening the two lock nuts 68 thereon. It is desirable to adjust the stop 67 so that the elongate pivot arm 44 is urged to a position just above the surface of the guide rail 47, as seen in FIG. 5, when no downward force is applied.

The channel-shaped bracket on each of the pivot arms 44 also includes a downwardly projecting flag 69 at the forward end thereof. A photosensitive switch 71 includes a light source projecting a light beam across a gap to a light sensor directly below the flag 69. The photosensitive switch 71 is positioned such that when the elongate pivot arm 44 is pivoted downwardly against the tension preset in the coil spring 57, the flag 69 assumes a position to intercept the light beam and accordingly changes the electrical output of the photosensitive switch. Thus, the photosensitive switch 71 senses the pivoting of the associated pivot arm 44 and provides a signal which is indicative thereof.

Each of the scale assemblies 42 and 43 is mounted on the associated guide rail 47 by a pair of bolts 72 (FIGS. 4, 5 and 5B) which pass through the scale assemblies and engage threads in threaded holes formed in the guide rail. The length of the pivot arms 44 which are exposed to bear the weight transmitted through the support pins 46 for each of the cups 15 is less than one cup pitch so that there is never more than the weight of one cup and its contents on any pivot arm at any one time. Moreover, the scale assemblies 42 and 43 in each lane are mounted on their respective guide rails 47 approximately two cup pitches apart. As seen in FIG. 3, when a cup support pin 46 is received on the high range scale 42 another cup support pin is received at a corresponding point on the low range scale 43 two cup pitches away.

It should be recognized that load cells (force sensitive transducers) of a conventional type may be used in place of the scale assemblies 42 and 43. The cells would be properly positioned on the guide rails 47 to support the cups 15 in sequence as they pass in each lane. An output signal indicative of force applied to or weight supported by each load cell would be processed and utilized by the system to obtain the same ends as are obtained with the signal from the photosensitive switch 71 to be hereinafter discussed.

A plurality of spaced discharge stations or drop points are located downstream from the weighing stations, the first of which is located in the area shown beneath the arrows 6—6 of FIG. 2. Prior to describing the details of each of the discharge stations, it should be noted that one of the conveyor drive chains 34 has a magnet 73 (FIG. 1) attached thereto. Immediately downstream from the weighing stations a magnetic switch 74 (FIG. 1) is attached to the guide rail 47 which the drive chain carrying the magnet 73 passes closely adjacent thereto. The magnetic switch 74 serves as a reference point on the conveyor frame structure for a purpose to be hereinafter described. Each of the downstream discharge stations also has a magnetic switch 76 (the switch for the first discharge station being shown in FIG. 6) which is mounted on an outer guide rail extension **47*a* so that when the magnet 73 passes thereby on the adjacent conveyor drive chain 34 a switch output signal will be generated. It will be noted that the guide rail extension 47*a* forms a downstream extension of the guide rail 47 at the weighing stations but extends outwardly thereof so as to support the cup pins 46 at their outer ends rather than at their inner ends. The magnetic switches 74 and 76 serve to define the positions of the downstream discharge stations relative to the downstream end of the weighing stations in terms of cup pitch lengths (i.e., the distances between successive cups 15 carried by the conveyor chains 34) as will hereinafter be described in greater detail. Also located just downstream of the weighing stations is a photosensitive switch 77 (FIG. 1) which is mounted on the inside surface of the left side frame member 36. A light source (not shown) is disposed on the inside surface of the left side frame member 36 below the level of the conveyor chains 34 and in alignment with switch 77. A light beam is directed upwardly toward the photosensitive switch 77 and is interrupted as each of the cup support rods 38 passes between the light source and the photosensitive switch. The output from the photosensitive switch, which occurs once for each passing transverse row of cups 15, is used to confirm the completion of a weight measurement at the scales 42 and 43** for that row of cups.

Each discharge station has a control circuit box 78 (FIGS. 1 and 2) mounted on the left side frame member 36. An emergency "power-off" button 79 is provided on each control circuit box at each discharge station so that the apparatus may be shut down immediately from a variety of positions in the event of an emergency. A series of eight manually operated switches is contained in the control circuit box at each discharge station to provide means by which the address for that specific discharge station can be manually set, as will be described in greater detail hereinafter. A rotary solenoid drive circuit, also to be hereinafter described in greater detail, is also contained in each of the discharge station control circuit boxes. Thus, each of the discharge station control circuit boxes is identically configured for the purpose of reducing complications in manufacture and inventory.

Figure 6:
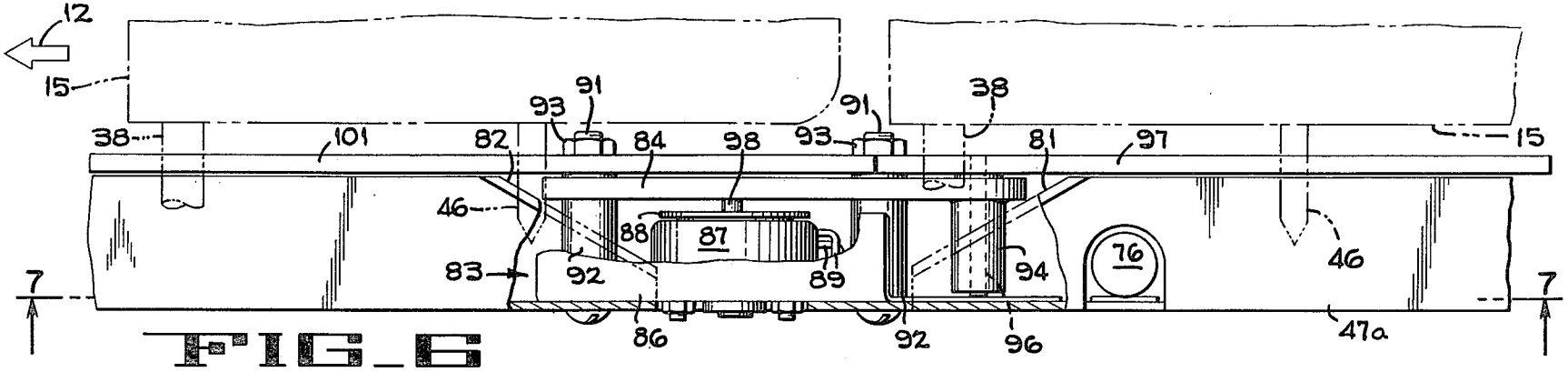
FIG. 6 is an enlarged fragmentary plan view taken in the direction of arrows 6—6 of FIG. 2 and showing one of the discharge stations and the associated gate operating mechanisms.
Figure 7:
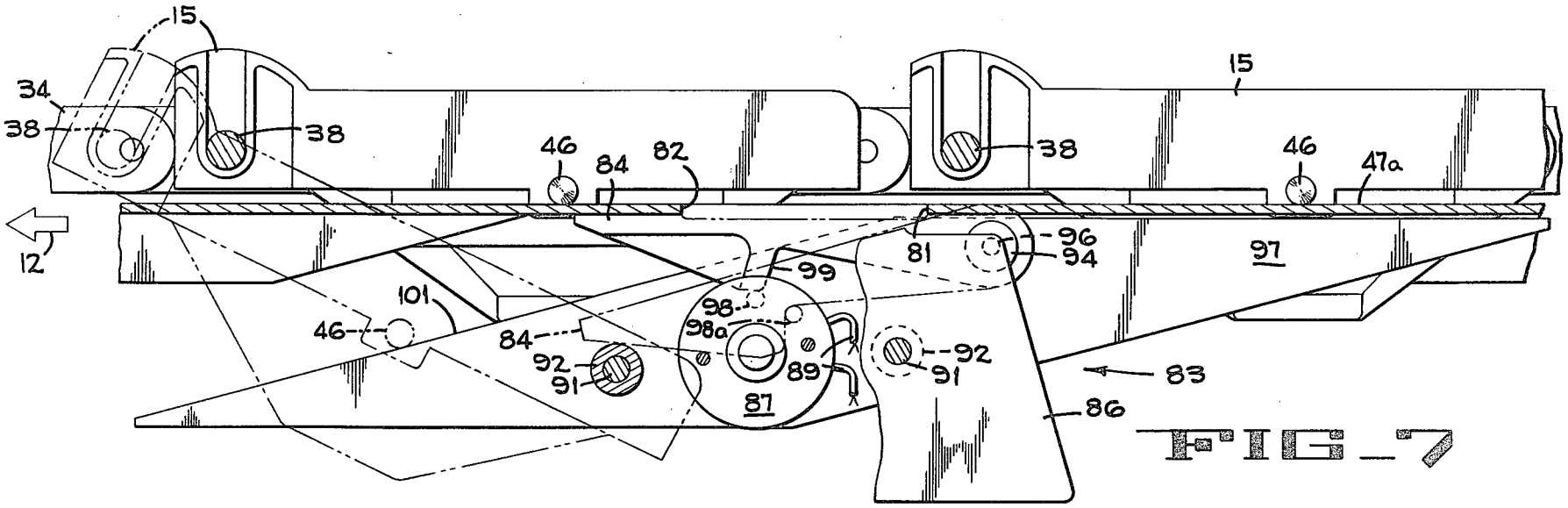
FIG. 7 is a section taken along the line 7—7 of FIG. 6 with the magnetic switch 76 being deleted and with the discharge gate being shown in its discharge position in phantom lines.
Figure 4:
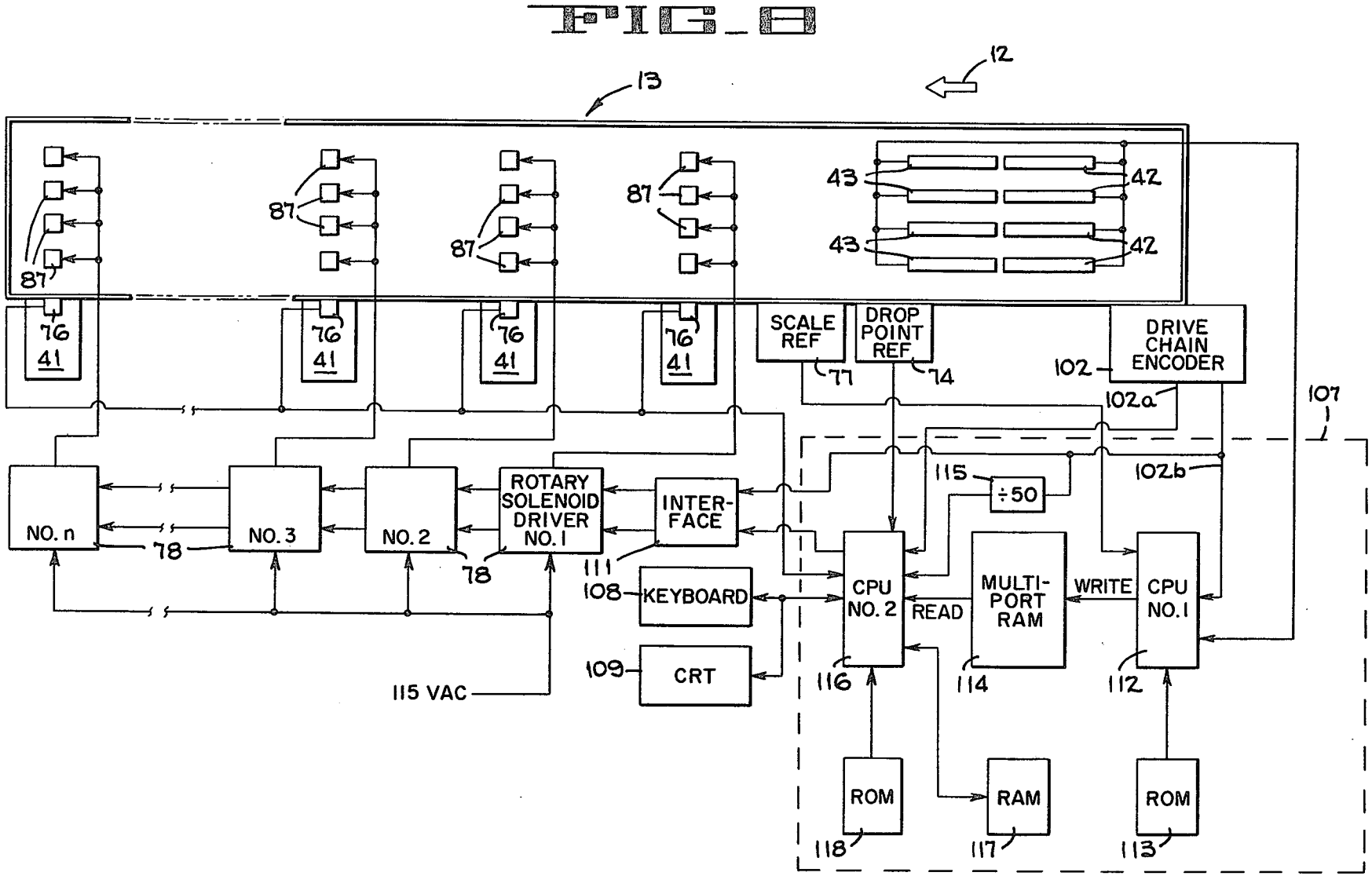
Figure 5:
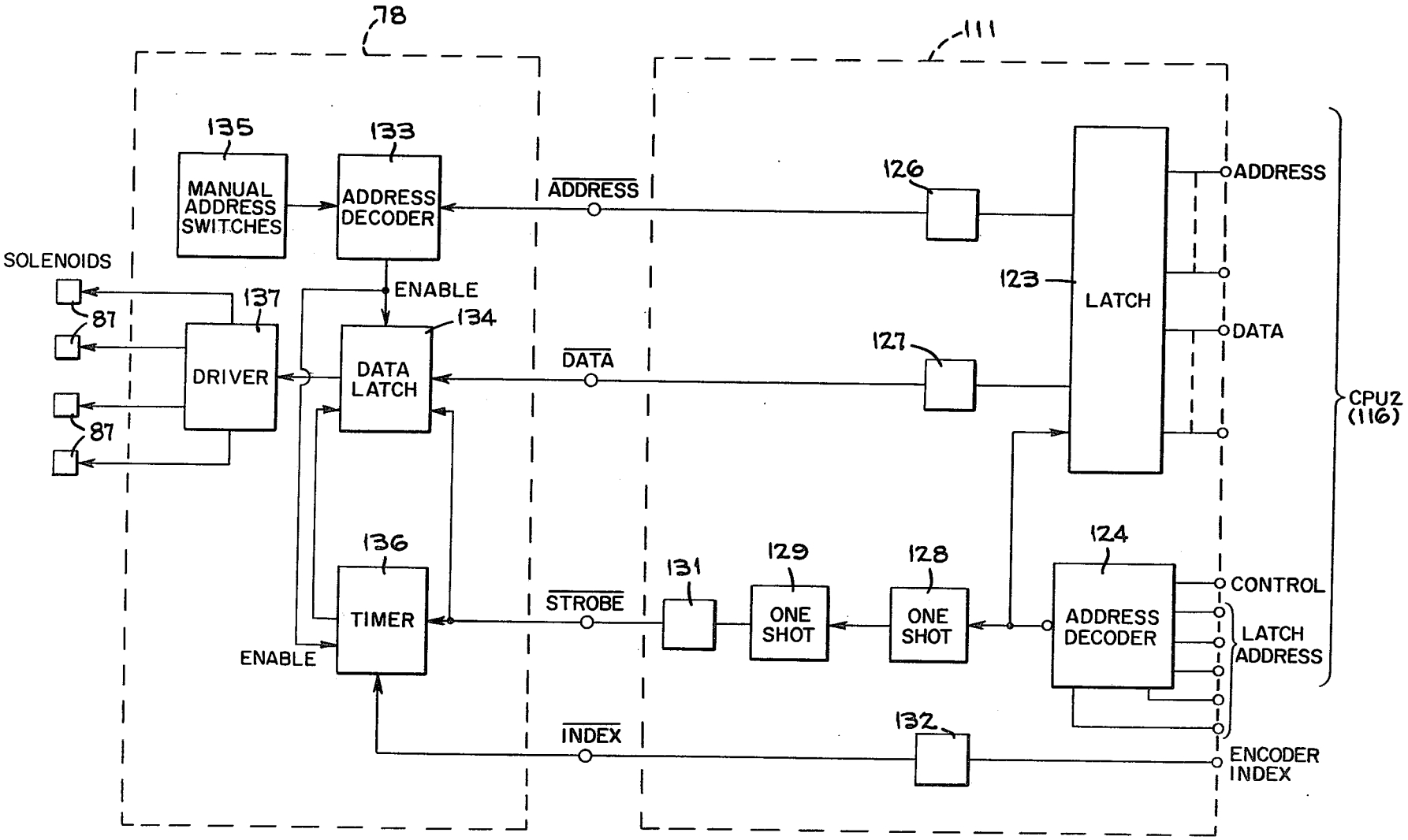

FIG. 6 depicts one of the channels of the first one of the discharge stations with the passing conveyor cups 15 being shown in phantom lines. That portion of the associated guide rail extension **47*a* which contacts the cup support pins 46 to thereby hold the cups in their normal apple carrying positions has an opening at each of the discharge stations to permit selective discharge of the cups passing thereby. The upstream edge of the opening is seen at 81 in FIG. 6, and the downstream edge of the opening is seen at 82 (both of said edges being partially broken away and shown in phantom lines). A discharge gate assembly 83 is mounted to the inner surface of the guide rail extension 47*a* at the opening and includes a gate member 84 which is movable in the opening between the edges 81 and 82 to either bridge the opening at the level of the upper surface of the guide rail 47 (as shown in full lines in FIG. 7) or to assume a position pivoted downwardly from the opening (as shown in phantom lines in FIG. 7). A cover 86 is provided below the support surface of the guide rail extension 47*a* for surrounding a rotary solenoid 87 to prevent dust and debris from entering and jamming the solenoid over a prolonged period of use. A rotatable selenoid plate 88 is driven by the solenoid when the solenoid is energized through a pair of electrical leads 89. The gate member 84 has a boss 94 projecting laterally therefrom through which a pivot pin 96 extends, with the gate member being rotatable upon the pin to permit it to assume its discharging position (FIG. 7). The pivot pin is captured in a ramp plate 97. The rotatable solenoid plate 88 carries thereon a cam follower pin 98 to support the gate member in its normal and discharge positions (FIG. 7). A pair of bolts 91 pass through the outer vertical face of the guide rail extension 47***a*, through spacers 92, and through the ramp plate 97 where they are engaged by a pair of nuts 93 to secure the gate assembly 83 to the conveyor frame structure at the discharge station.

As may be seen in full lines in FIG. 7, the cam follower pin 98, in its uppermost position, provides support for the gate member 84 in the normal position of the gate member spanning the opening in the guide rail extension 47*a* between the edges 81 and 82. When the rotary solenoid 87 is electrically energized, the cam follower pin 98 is rotated downwardly to the position seen as 98*a* in FIG. 7, and it may be seen that the gate member will fall by the force of gravity about the axis of the pivot pin 96 until a cam surface 99 on the underside of the gate member is received by the cam follower pin in position 98*a*. With the gate member 84 in the lowered discharging position relative to the opening in the guide rail extension 47*a*, the passing cup support pin 46 will depart from the upper surface of the guide rail extension and traverse a down ramp 101 formed on the upper surface of the ramp plate 97. As the support pin proceeds along the down ramp 101, it may be seen that the supported cup 15 departs from its fruit carrying position and begins to pivot about the cup support rod 38 to ultimately assume a hanging discharge position.

The discharging of the apple from a cup 15 at a discharge station located along the length of the conveyor structure 13 is described more fully with reference to FIG. 13 which shows the sequential pivoted positions of a cup in phantom lines. When the rotary solenoid 87 is not actuated, the support pin 46 for each cup slides across the surface of the associated guide rail extension 47*a* with the upper edge of the gate member 84 maintaining the cup in its horizontal carrying position. When the gate member 84 is pivoted downwardly into the discharge position by actuation of the corresponding rotary solenoid 87, the support pin 46 on the next arriving cup is shunted downwardly on the down ramp 101 as previously described. The cup pivots in a clockwise direction as seen in FIG. 13. When the support pin 46 passes the lower end of the down ramp, the cup is free to swing into a position where it hangs in a vertical plane from the cup support rod 38, and the apple being carried therein will tumble out. A deflection ramp 100, preferably having a cushioned surface thereon, is positioned so that it contacts the falling apple and deflects the apple toward the take-away conveyor 41. The take-away conveyor extends laterally across the apparatus, and thus is capable of receiving apples from any of the four channels of the conveyor 13. The cup is carried in the hanging position after it discharges the apple until it is repositioned into the horizontally oriented attitude at the front end of the conveyor adjacent upper end shaft 24; this is accomplished by extending the guide rails 47 about the shaft 24 so that they pick up the pins 46 as they are elevated vertically between shafts 35 and 24 (such means being conventional and not being shown herein). When a solenoid 87 has been energized, it will be deenergized after the cups have travelled through a distance substantially equivalent to one-half cup pitch when the support pin 46 of the discharging cup will have just cleared the end of the gate member 84 (FIG. 13). A contained spring in the rotary solenoid urges the cam follower pin 98 from position 89*a* back to its normal upper position when the solenoid is deenergized. The cam follower pin 98 moves along the cam surface 99 to lift the gate member until the gate member is repositioned to bridge the gap in the guide rail extension 47*a* between the gap edges 81 and 82.

The manner in which the scales 42, 43 for each of the conveyor channels are monitored and the solenoids 87 are energized for actuating the various gate members 84 in accordance with the weights determined by the scales will now be described in conjunction with the circuitry diagram of FIG. 8. The four channel conveyor 13 is there shown diagrammatically having the four sets of high and low range scales 42, 43 near the front end thereof. Flow on the conveyor is indicated by the feed direction arrow 12 which corresponds to the arrow 12 in FIG. 1. The conveyor 13 has a plurality of discharge stations located therealong at each of which a take-away conveyor 41 is located as hereinbefore described. The magnetic switch 74 positioned adjacent the downstream end of the weighing stations is shown in FIG. 8 together with the magnetic switches 76 positioned at each of the downstream discharge stations. It will be recalled that the magnetic switches 74 and 76 function in cooperation with the magnet 73 (FIG. 1) on one of the conveyor chains 34 to provide location identification for the discharge stations relative to the downstream end of the weighing station containing the scales 42 and 43 in terms of conveyor cup pitch lengths, it being recognized that these figures could vary as the conveyor chains change length due to stretching or temperature effect even though the distances between the scales and the discharge stations will remain fixed. The potosensitive switch 77 is shown as the "scale reference" and indicates that a line of cups 15 have just been weighed and are off of the pivot arm 44 of the downstream scale 43 in the weighing station. It should be noted that since corresponding points on the scales 42 and 43 are positioned two cup pitches apart and there is a distance slightly in excess of one cup pitch between the scales (FIG. 3) the photosensitive switch 77 is positioned sufficiently close to the downstream end of the "light" scale 43 so that the "scale reference" signal is provided while there are no cups riding on the scale bars 44. A drive chain encoder 102 is provided as shown in FIG. 8 and FIGS. 1 and 2. The encoder is seen (FIG. 2) to be driven by means of a timing belt 103 which engages a gear 106 on the drive shaft for the encoder and a gear 104 on the upper end shaft 24. The gear ratio between the gears 104 and 106 is such as to produce a reference signal pulse for each increment of travel of the conveyor drive chains 34 equivalent to one cup pitch, such signal pulses being produced at an output indicated as 102*a* in FIG. 8. The drive chain encoder 102 also produces index signals at an output 102*b* at a rate of 500 pulses for each pulse produced on output 102*a*. is a machine controller 107 (FIG. 8) which receives the outputs from the photosensitive switches 71 on the scales 42 and 43, the single pulse per cup pitch and the 500 pulses per cup pitch outputs from the drive chain encoder 102, the magnetic switch outputs from the magnetic switches 74 and 76, and the output from the photosensitive switch 77 indicating when a line of cups 15 has passed off the pivot arm 44 of the downstream scale 43. Also coupled to the machine controller 107 is a control keyboard 108 and a cathode ray display tube 109 which is utilized for displaying the program instructions for the machine controller 107. Outputs from the machine controller are coupled to an interface circuit 111 and include address information, data and control signals. The interface circuit also receives the 500 pulse per cup pitch signal from the output **102*b* of the drive chain encoder 102. The interface circuit provides a party line output which is coupled to a plurality of the downstream discharge station control circuit boxes 78 mentioned hereinbefore. The party line from the interface circuit includes the address information and the data and strobe signals providing for the execution of properly addressed data at the discharge stations. The drive chain encoder 500 pulse per cup pitch signal (line 102*b* is also coupled to each of the discharge station control circuit boxes as an index signal for purposes to be hereinafter described. The discharge station control circuit boxes 78 are connected to the four solenoids 87 at each particular discharge station to thereby control the condition of the gate members 84** at that station in accordance with weight data obtained by the prior weight measurements which have been stored in the circuitry of the machine controller.

The machine controller 107 is seen (in FIG. 8) to be coupled to the photosensitive switch outputs from the high and low range scales 42 and 43 located in each channel of the channelized conveyor 13. When a cup 15 is carrying an apple, the conveyor drive chains 34 carry the cup and the apple along the conveyor path with the support pin 46 sliding along the surface of the guide rail 47. Upon reaching the front ramp 48 (FIG. 5) of the high range scale 42 the pin slides up upon the ramp and continues along the upper surfaces of the right and left side plates 49 and 51 until the weight of the cup and the apple are supported on the top of the elongate pivot arm 44 (which occurs at the plane normal to the paper indicated by the letter "X" in FIG. 5). Adjustment may be made by means of the knurled adjusting nut 62 to place enough tension in the coil spring 57 so that a predetermined range of apple weights, for example 170 to 340 grams, will cause the elongate arm 44 to pivot about the axis of the cross member 52. In the aforementioned example, if the apple is a 340 gram apple or greater, the pivot arm will be depressed against the yieldable upward force exerted on the pivot arm 44 by the coil spring 57 as soon as the support pin 46 is received upon the elongate pivot arm 44 at position "X" (FIG. 5). On the other hand, if the apple is a 170 gram apple, the arm 44 will not pivot downwardly against the spring tension until the support pin 46 is at the very end of the pivot arm 44. Apples between 170 grams and 340 grams will deflect the pivot arm downwardly at points between position "X" and the free end of the arm in exact proportion to the weight of the apple; that is to say, if an apple weighed 255 grams, it would deflect the arm 44 at a position half-way between position "X" and the end of the arm, etc. When the support pin 46 reaches a point where the arm 44 is caused to pivot downwardly, it may be seen that the flag 69 will interrupt the light beam in the photosensitive switch 71 and an output indicative of such interruption will be provided.

If the apple is too light to actuate the photosensitive switch 71 in the high range scale 42, the cup 15 proceeds to the low range scale 43 downstream therefrom where the tension in the coil spring 57 is adjusted differently to allow the elongate arm 44 to be rotated downwardly against the spring tension by (for example) weights in the range of 85 to 170 grams. The low range scale 43 functions in exactly the same fashion as the high range scale 42 producing an output from the photosensitive switch 71 when the weight transmitted to the elongate pivot arm 44 by the support pin 46 is sufficient to depress the pivot arm with the relative distance between the "scale on" position (indicated at "X") and the position where the deflection occurs directly corresponding to the weight of the apple within the indicated range.

The signal states of the photosensitive switches 71 are brought into the machine controller 107 on eight separate lines and connected to a microprocessor or central processing unit (CPU #1) indicated at 112 in FIG. 8. It may also be seen that the CPU #1 receives the 500 pulse per cup pitch index signal from the output **102*b* of the drive chain encoder 102. At a conveyor speed of 300 cups per minute each pulse in the 500 pulse per cup pitch train will have a period of 400 microseconds. During each of these pulses, which are termed index pulses, CPU #1 scans all of the scales in the high and low ranges, numbering eight in this embodiment, to find out which of the photosensitive switches 71 indicate that a corresponding pivot arm 44** is depressed. CPU #1 looks at each of the photosensitive switches during a scan, and if the switch output indicates that the corresponding pivot arm has been rotated downwardly, a counter in CPU #1 corresponding to that switch and a particular cup is incremented by one count.

It will be noted from FIG. 3 that the weighing station for each channel of the apparatus is arranged relative to the apple-carrying cups 15 so that cups in a given lane are in the same relative positions with respect to the scales 42 and 43 and so that three cups in each lane will need to be monitored at any given time. As a cup moves into the weighing station area, it will be assigned a pair of counters (in the CPU #1) which will record the weight on the high and low range scales for that cup. Thus, as a first cup goes off the pivot arm 44 of the downstream scale 43, the second cup will not yet be on the pivot arm. The third cup will just have moved off the pivot arm of scale 42, and the fourth cup will not yet have gone on the pivot arm for scale 42. It is at such time that the photosensitive switch 77 senses the support rod 38 of the first cup to cause the control circuitry to evaluate the data in the two counters corresponding to the first cup, transfer the relevant data from such counters, and reassign such counters to the fourth cup. Thereafter the index pulses are made available for incrementing of the counter for scale 42 (the "heavy" counter) for such fourth cup and for incrementing of the "light" counter for the second cup when the respective scale bars are depressed. The "heavy" scale count for the third cup is complete and it lies between the heavy and light scales. When the second cup is subsequently sensed by switch 77 after moving off the downstream end of the light scale 43, the aforedescribed process is repeated, and thereby the two counters associated with each cup will be alternately incremented in accordance with the scale switch readings for both of the scales and the data subsequently transferred to CPU #1.

It has been found that all eight of the scales may be scanned and all of the relevant counters may be incremented during a period of approximately 280 microseconds which, being less than the 400 microseconds available between index pulses, is easily sufficient.

It will also be noted that once a pivot arm 44 of a scale is depressed, the relevant counter will be incremented and will continue to be incremented each index pulse until the cup support pin 46 moves off of the pivot arm. The count in the counter will then be indicative of the distance travelled by the cup while the pivot arm was depressed which, in turn, is directly proportional to the weight of the apple carried by the cup.

The scale reference signal from the photosensitive switch 77 is thus coupled to CPU #1 for the purpose of providing an indicator signal to the processing unit 112 that the cups are no longer on the pivot beams 44 of the scales 42 and 43 so that the machine controller is assured that the weight data obtained during the scale scan is complete. A read only memory (ROM) 113 is coupled to the CPU #1 for the purpose of providing permanent program instructions relative to the routine performed by the CPU in using the scale reference signals, the weight indicative signals, and the index signals.

The weight data provided by the CPU #1 for each successive set of cups 15 is transferred to a multiport random access memory (RAM) 114 after each set of cups clears the downstream scale 43 when indicated by output from switch 77 (as previously explained) which RAM stores the data until it is called up by a central processing unit number 2 (CPU #2) seen as item 116 in FIG. 8. CPU #2 not only reads the weight data in the multiport RAM but also has coupled thereto the single pulse per cup pitch signals from the output 102*a* of the drive chain encoder. A divide-by-fifty circuit 115 receives the 500 pulse per cup pitch signals from line 102*b* of the drive chain encoder therefore providing a reference signal which is ten times the frequency of the reference signal from the output 102*a* of the drive chain encoder. The drop point reference signal from the magnetic switch 74 is coupled to CPU #2 together with the outputs from each of the magnetic switches 76 at the individual downstream discharge stations. The keyboard 108 is also coupled into CPU #2 together with a random access memory (RAM) 117 functioning in conjunction with the keyboard to read and write the variable program instructions to CPU #2. A read only memory (ROM) 118 is also coupled to CPU #2 for the purpose of providing the permanent program instructions thereto.

CPU #2 operates to classify each of the apples carried through the weighing station by a cup 15 in each of the channels of conveyor 13 as well as to provide the appropriate drop signals for the weighed apples. CPU #2 also provides a drop point calibration-process and a communication scan process which latter process involves the receipt of information from the keyboard 108 in response to keyboard selections and the appropriate generation of a program in accordance therewith and the fixed program instructions from ROM 118.

When the system is first turned on and the multichannel conveyor 13 is energized, the outer conveyor drive chain 34 with the magnet 73 thereon (seen in FIG. 1) transports the magnet past the magnetic switch 74 and each of the downstream magnetic switches 76 located at each downstream discharge station. During the first circuit of the magnet 73 around the endless conveyor path the switch pulses from the magnetic switches 74 and 76 are received by CPU #2. In accordance with the instructions contained in ROM 118 the system is first placed in a "find drop points" routine which routine is initiated by receipt of the first drop point reference signal from magnetic switch 74. The distance from the downstream end of the weighing stations (where the switch 74 is set) to each of the downstream discharge stations or drop points (where the magnetic switches 76 are set) is thereafter measured in terms of cup pitch lengths (in a manner to be described hereinafter) in order to calibrate the apparatus—a procedure which is necessary at frequent intervals in view of chain stretch. The computed cup length distances from the switch 74 to each of the drop points is then stored in the RAM 117.

Figure 10:
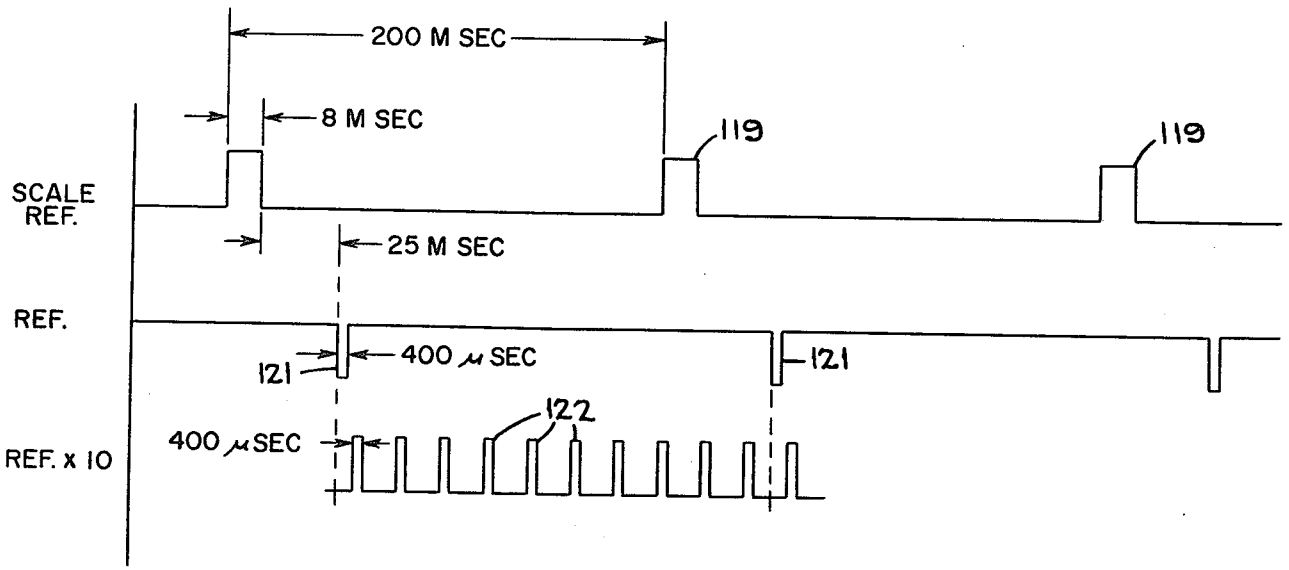
FIG. 10 is a timing diagram showing some of the control signals in the weight sizing apparatus circuitry.

Referring to FIG. 10, a timing diagram is provided wherein the scale reference pulses 119 from the photosensitive switch 77 are shown having a repetition rate of approximately 200 milliseconds and a dwell time of approximately 8 milliseconds (the time scale not being drawn proportionately). Approximately 25 milliseconds after termination of the dwell time of a scale reference pulse a reference pulse 121 is produced which pulses occur once each cup pitch at the output 102*a* (FIG. 8) of the drive chain encoder 102. A train of pulses 122 from the output of the divide-by-fifty circuit 115 is seen occurring at a pulse rate which is ten times that of the reference pulses 121 and out of phase therewith (as shown). Both the reference pulses 121 and the reference pulses 122 have a dwell time of approximately 400 microseconds as indicated. As stated hereinbefore, the scale reference pulses 119 are used by the CPU #1 to monitor the weight-taking and transferring operations therein. Each of the reference pulses 122 provides an interrupt to the CPU #2 directing the processor to look into the drop reading position in an apple drop memory table and inquire as to whether any apples need to be dropped at any of the drop points at the downstream discharge stations. The apples carried on the multichannel conveyor 13 for which weight data has been obtained are classified in the memory table in the RAM 117 circuitry in accordance with the weight data as discussed hereinafter, and the data is located in memory such that it relates to the drop reading position in accordance with a number of pulses 122 which occur between the time the apple is classified and the time the apple reaches its drop point. This process of inquiry, dropping and classification is repeated for each channel in the multichannel conveyor in sequence for those cups 15 which have just been weighed and will subsequently be described in more detail. Thus, during each period of the pulses 122 (FIG. 10) for the first four of such pulses following a pulse 121 an apple in a lane is classified and appropriate drop commands are generated. On the occurrence of each of the reference pulses 121 the weight data is taken into the CPU #2 from the multiport ram 114. As described hereinbefore, during the period of the scale reference pulse 119 the weight data is transferred from CPU #1 to the multiport RAM 114. As a consequence, the output information from CPU #2 which is coupled to the interface circuit 111 contains address information, weight data, a control signal and latch address information.

Figure 14:
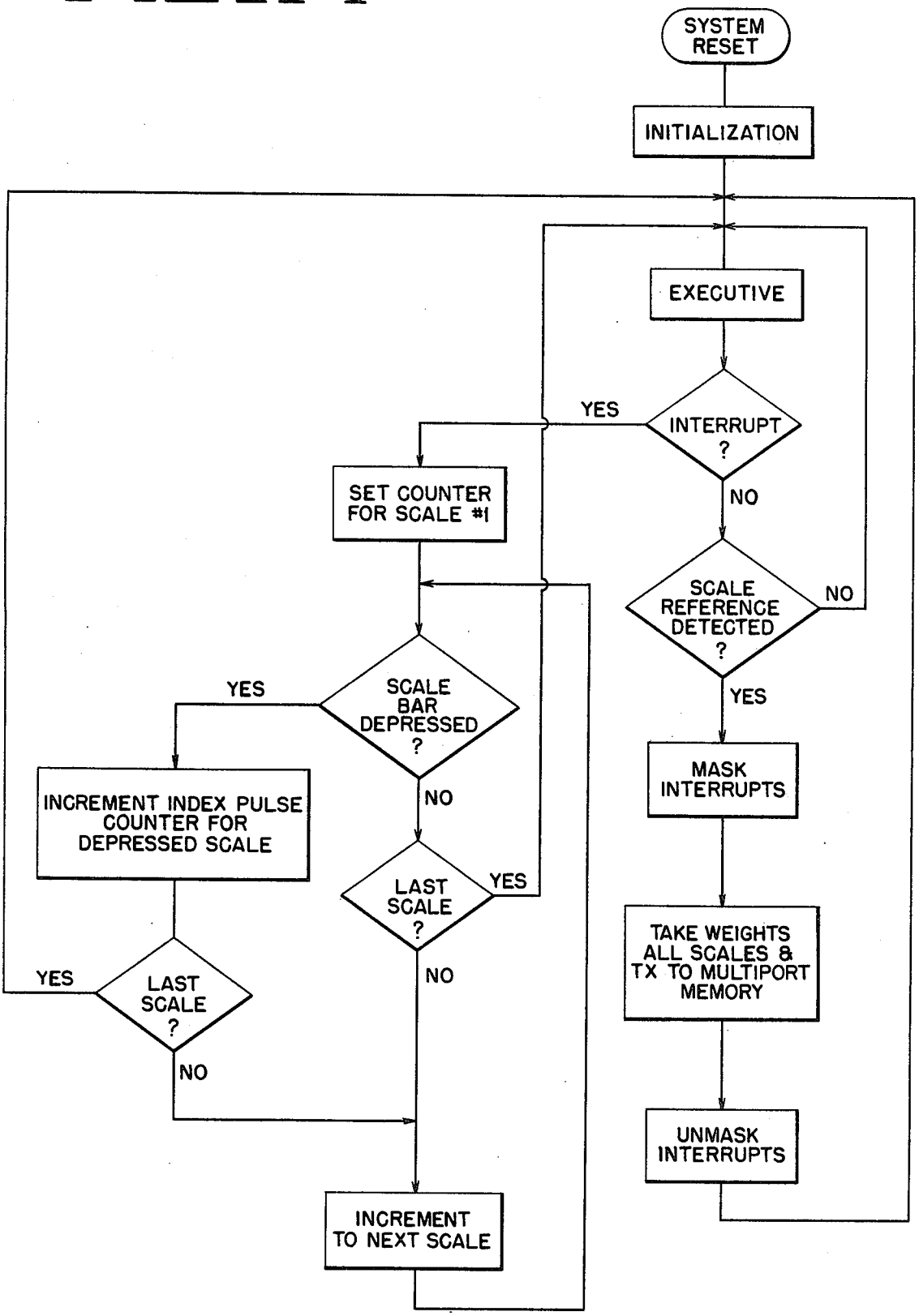
FIG. 14 is a flow diagram of a program for controlling the central processing unit for the weighing operations in the sizing apparatus.

It is useful here for the purpose of amplifying the description of the manner in which the machine controller 107 operates to describe the programming of ROM's 113 and 118 in a preferred embodiment. Referring to FIG. 14 a flow chart is shown for the program contained in the read only memory 113 which provides direction for CPU #1. A system reset function is provided which occurs in either of two instances. A system reset is provided when power is initially turned on in the system and also when a manual switch (not shown) in the system is actuated. The system reset function is performed without regard for the system history and simply returns the program to a starting point. A subsequent initialization step is provided in the routine which gets the system ready for what is to follow. All random access memories in the system are cleared, certain locations within the circuitry are set to predetermined states and a data base for the system is established. Thereafter the program proceeds to an executive routine, as seen in FIG. 14, which oversees two subroutines in this portion of the system, an interrupt service subroutine and a scale sub-routine. The interrupt service routine is normally provided with priority over the scale routine. An interrupt inquiry is performed for each of the index pulses from the drive chain encoder 102 at output 102*b*, thereby occurring 500 times for each increment of travel by the conveyor chains 34 equal to 1 cup pitch. If an interrupt command (i.e., a pulse 122) is present, a counter in CPU #1 is set for scale number 1. Thereafter, the inquiry is made as to whether the scale bar for scale number 1 is depressed. If the answer is "yes," index pulse counter for scale number 1 with the scale bar depressed is incremented by one count. Thereafter, the inquiry is made as to whether this is the last scale of the eight scales in this embodiment to be scanned. Since this is the first scale in the sequence in this instance, the answer is "no." The counter is then incremented to the next scale, which in this instance is scale number 2. The inquiry is again made as to whether the scale bar is depressed. In the event the answer to this inquiry is "no," the inquiry is made as to whether this is the last scale in the sequence of eight described herein. Since this is the second scale in the sequence, the answer to the latter inquiry is "no," and the scan is incremented to the next scale, scale number 3 in this instance. The foregoing sequence is followed for each of the scales until the eighth, or last scale, in this embodiment is coupled to its counter. If the scale bar is depressed on the eighth scale, the counter for the eighth scale is incremented by one count. The ensuring last scale inquiry is then answered "yes" and the routine is returned to the executive function. If the answer is "no" to the inquiry as to whether the scale bar is depressed, a subsequent last scale inquiry is then answered affirmatively and the routine also returns to the executive function.

In the program flow chart of FIG. 14, if the interrupt inquiry is answered "no," a subsequent inquiry is made as to whether the scale reference is detected. The scale reference detection signal, as hereinbefore described, is provided by the optical sensor 77 which is sensitive to the passage of the rods 38 which couple the cups 15 to the conveyor chain 34 on the machine. If the scale reference detection inquiry is answered "no," the routine is returned to the executive function. If the last mentioned inquiry is answered affirmatively, the interrupt function is masked so that it will not be initiated. In essence this switches priority to the scale routine. The weights are then taken from the counters in CPU #1 for all eight scales and are transferred to the multiport random access memory 114 seen in FIG. 8. Thereafter the interrupt function is unmasked and the routine is returned to the executive function. The weight data transferred from CPU #1 to the multiport RAM 114 is thereby made available to be read by CPU #2.

Figure 15:
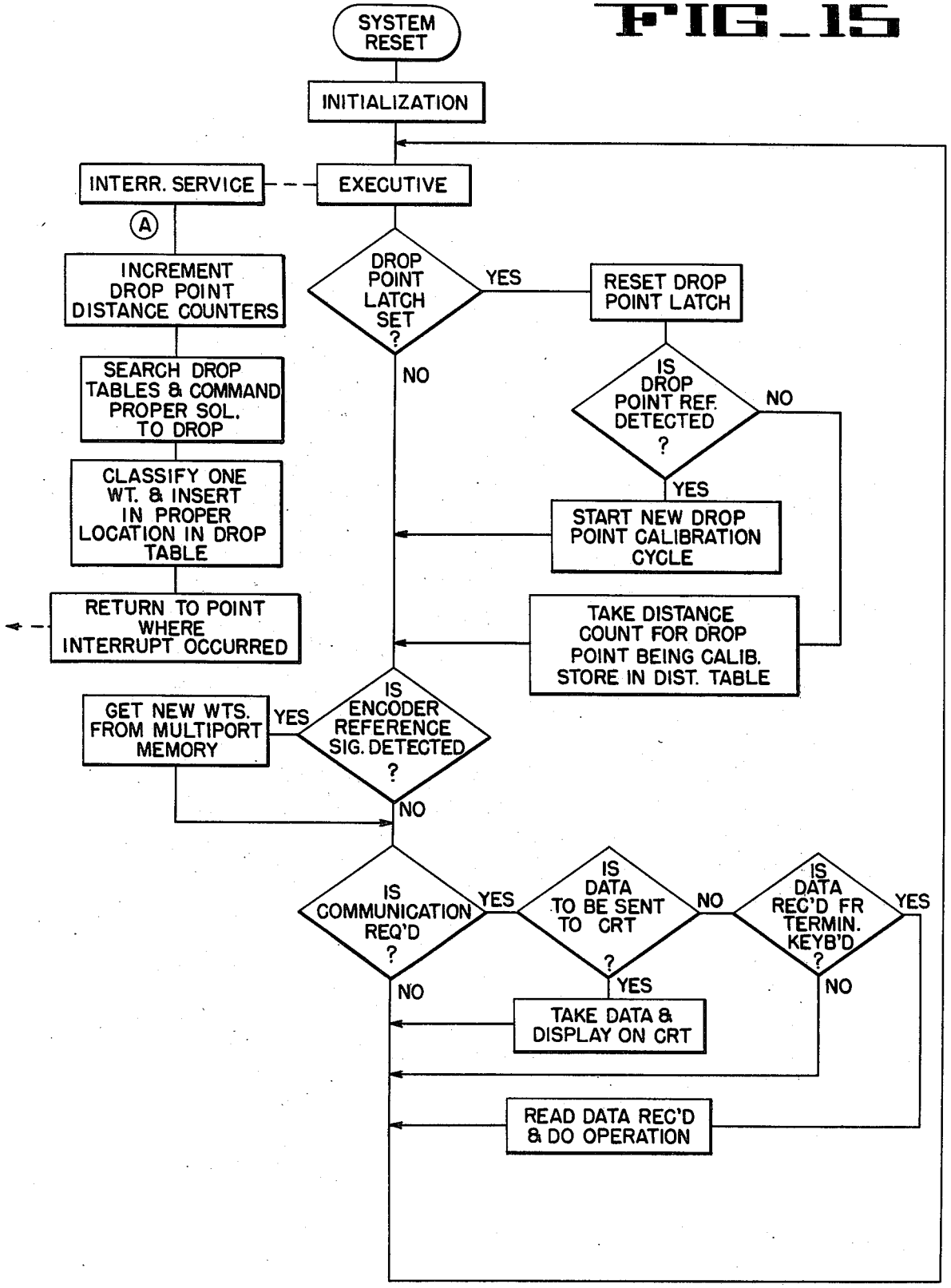
FIG. 15 is a flow diagram of a program for controlling the central processing unit for the discharge operations in the sizing apparatus.

FIG. 15 shows the program flow chart for the functions contained in the read only memory 118 which are implemented by the CPU #2. An initial system reset function is shown which is performed when the power is first applied to the system. A subsequent initialization step is performed wherein all of the memories are cleared. Data is sent from the system to the CRT 109 (FIG. 8) where a blank apple delivery schedule, or a standard cut point table, is displayed depending on selection at the keyboard 108. Thereafter, the executive routine is entered wherein three indicators are sequentially scanned and the indicated ones of three major subroutines associated with such indicators are entered. These subroutines are (sequentially) the drop point calibration subroutine, the new weight information subroutine and the communication service subroutine. A fourth major subroutine, the interrupt service subroutine, can be entered at any time to override the foregoing three subroutines. In making a decision as to whether or not to enter the first subroutine, an initial inquiry is made as to whether a circuit drop point latch is set, said drop point latch being set each time a pulse is received from the switch 76 at one of the drop stations or from the drop point reference switch 74 as the magnet 73 passes thereby. If any of these switches is set it is time to enter the drop point calibration routine for the particular drop station from which the switch 76 signal was received or to initiate a calibration cycle if a switch 74 signal is received. The drop point latch is immediately reset after entering this subroutine so that the "yes" answer to the latch set inquiry is removed and meaningful subsequent drop point latch setting inquiries may be made. The inquiry is then made as to whether the drop point reference is detected, i.e., the signal provided by the drop point reference switch 74 which may be seen in FIGS. 1 and 8 at a point immediately downstream of the light weight scales 43. If the answer to the latter inquiry is "yes," a new drop point distance calibration cycle is undertaken, i.e., the calibration counter for the drop stations is cleared. Recalibration is therefore performed for every revolution of the conveyor chains 34 and is initiated by the signal from the drop point reference switch 74. If the answer to the drop point reference inquiry is "no", i.e., the drop latch is set by a signal from a drop point switch 76, then a single distance count for the drop point indicated by the appropriate magnetic switch 76 which has set the drop point latch is taken (by reading the calibration counter) and stored in a drop point distance table. The distance counts are cumulative and are provided by the reference pulses 122 seen in FIG. 10. Each distance count is taken from the calibration counter without disturbing the count therein, and the count is stored as the latest distance calibration for the drop point at which the switch 76 is actuated. A distance measurement is thereby provided which is accurate to within one tenth cup pitch.

Next, the system senses whether or not the encoder reference signal is detected. The encoder reference signal is provided once each cup pitch, as hereinbefore described, and may be seen as the reference pulse 121 in the timing diagram in FIG. 10. If the encoder reference signal is present, the newest weights are retrieved by CPU #2 from the multiport RAM 114. The retrieved weight data is transferred from the multiport RAM to the CPU #2 about 1/6 of a cup pitch after the weight data has been transferred from CPU #1 to the multiport RAM as hereinbefore described.

If there is no encoder reference signal detected from output 102*a* of the drive chain encoder 102 or after performing the weight taking subroutine, the inquiry is made as to whether communication within the system is required, e.g., when information relative to changes in the weight ranges of apples to be dropped at the various stations or in changes in the weight counter calibrations are to be made and displayed. This amounts to an inquiry as to whether new information is available at the keyboard 108 and whether the CRT display should be altered because of inputs from the keyboard 108 (FIG. 8). A subsequent inquiry is also made as to whether data is to be sent to the CRT for display during the communication subroutine.

An interrupt function is defined as being a system response to an input (in this case, the reception of a pulse 122) which, if the input is present, suspends whatever operation the system is undertaking and commands the system to perform a specific operation after which the system function returns to the identical point in the routine from which it departed when the suspension, or interrupt, command was received. Interrupt service is required in the present system as commanded by the reception by CPU #2 of each of the reference pulses 122 (FIG. 10) every one tenth cup pitch. With the reception of each pulse 122, the drop point distance counter (which provides drop point distance calibration) is incremented by one. Thereafter, an apple drop point memory table associated with each drop point distance counter is reviewed, and those apples in proper position at the drop points are dropped. One apple weight (for one of the lanes) is then classified and a drop signal is inserted in the proper location in the proper drop point memory table. The interrupt subroutine then is finished, and the CPU #2 is returned to that part of its normal routine which it was in at the time of reception of the interrupt signal (pulse 122). Thus, for the four lane system shown, the apples in each of the lanes will be classified and drop signals inserted in the appropriate tables during the first four pulses 122 following a pulse 121 where the new weight information is transferred from the RAM 114.

As mentioned hereinbefore classes or ranges of apple weights have already been preprogrammed by the system operator to be delivered to specific drop point locations. The description in this portion of the disclosure will relate to the classification of the apples by weight. As has been described hereinbefore there are a series of drop points along the length of the main multilane conveyor 13 at which the take-away conveyors 41 are located. These drop points may be numbered successively from the first drop point nearest the weighing scales 42 and 43 to the farthest drop point from the scales. While the aforedescribed control circuitry and memory for this machine may be set to handle a conveyor 8 lanes wide and 64 drop points long, only a four lane machine has been shown herein. For the sake of simplification the discussion that follows will not go beyond the third drop point along the length of the machine and will deal primarily with only one lane (lane one) on the machine.

In brief review, the machine passes an article, such as an apple, received in a cup 15 from the singulator 11 over the heavy scale 42, and any resulting weight data is stored in CPU #1. Two cup pitches later the same apple is passed over the light scale 43, and any resulting light scale weight data is stored in CPU #1. The microprocessor makes a decision relative to whether the light weight data should be thrown away or not depending on the answer to the query as to whether there is any heavy weight data stored. The appropriate weight data, heavy or light, is then transferred to the multiport ram 114 by actuation of the optical switch 77 (pulse 119, FIG. 10) when the cup support bar 38 cuts the beam directed thereto signifying completion of the weight taking process for that apple. Weight data is transferred from the multiport RAM 114 to CPU #2 by the next pulse 121 (FIG. 10) from output 102*a* of the drive chain encoder. An interrupt signal is provided by each pulse 122 (FIG. 10) from the divide-by-fifty circuit 115 which initiates the interrupt subroutine incrementing the drop point calibration counter by one count (as previously explained) and also providing a look at indexed data in the drop point memory segments (to be explained hereinafter), apple dropping, memory location clearing and classification of an apple in one of the lanes.

Each drop point on the machine of this embodiment has an address somewhere between hexadecimal 8000 and hexadecimal 803F. Since the weight classifications are programmed by the operator into the machine to provide for dropping at specific drop points for specific weight classifications, a particular apple weight when transferred from the multiport RAM 114 to CPU #2 by the occurrance of pulse 121 must be appropriately addressed. A 16-bit binary coded hexadecimal number within the aforementioned hexadecimal range is used for this purpose. For example, a weight programmed to be dropped at drop point number 3 will be assigned an address of 8002 hexadecimal. In binary coded form this will appear as 1000 0000 0000 0010. This may be seen in FIG. 18 where each of the 16 hexadecimal figures are shown above the sixteen bit spaces in which the binary code for hexadecimal 8002 is shown. The bits corresponding to hexadecimal places F, E, 8, 7 and 6 are used for address decoding as will be hereinafter explained. Addressing for reception by the correct one of the solenoid drivers 78 is provided by the least significant six bits corresponding to hexadecimal places 0 through 5. Thus, it may be seen that any binary coded hexadecimal number from 8000 to 803F (64 decimal numbers) will be decoded by the least significant six bit, and the FE876 bit sequence will appear as binary 10,000 for any number in that range.

CPU #2 has a plurality of memory segments associated with each of the individual ones of the drop points on the machine. FIG. 17 shows three memory segments corresponding to drop points 1, 2 and 3 each having 1 through m, 1 through n, and 1 through p memory locations, respectively, with the numbers "m", "n" and "p" directly corresponding to the number of interrupt pulses 122 between the signal from the switch 74 and the signal from the switch 76 for the particular drop point, e.g., "m" being the number of pulses 122 from the time that a particular apple is classified to the time that such apple is ready to be dropped at drop point 1. Each of the memory segments has a moving or rotating vector, or index, I1, I2 and I3 (FIG. 17) associated therewith which points to each of the stationary memory locations in sequence starting from the first and progressing through the last. When the last memory location in the segment for a particular drop point is reached, the index returns to the first location and progresses in sequence through all of the memory locations once again. The index is advanced each 1/10 of a cup pitch by the pulse 122, and therefore a new memory location is indexed in each drop point memory segment every time the conveyor 13 advances 1/10 of one cup pitch. The drop point calibration computation discussed previously with reference to the position of the magnetic switch 74 literally alters the length of each memory segment (the number of memory locations therein) for each drop point if the number of 1/10 cup pitches (i.e., timing pulses 122) from the position of the reference switch 74 to each drop point changes due to change in the length of conveyor chains 34. Therefore, drop point 2 memory segment, for example, may change from n locations to n+2 locations or n+1 locations depending upon the change in the number of one tenth cup pitches from the reference magnetic switch 74 to the magnetic switch 76 located at drop point two.

Presuming the drop points progress numerically in the downstream direction on the machine, it should be apparent that the memory segment for drop point 1 must be shorter than the memory segment for drop point 2 and the segment for drop point 2 must be shorter than the segment for drop point 3 and so on. The index vector for that segment of memory associated with drop point 1 therefore travels the circuit of memory locations assigned thereto in a fewer number of one tenth cup pitches than does the index vector for any other drop point memory segment. While the index vectors start out at the first memory location when the machine is first turned on and they are initialized, they are out of synchronization entirely after the conveyor belt has completed the first circuit on the machine.

The important factor to note here is that the index vectors sequentially address the memory locations in the memory segments assigned to a specific drop point. When the conveyor chain 34 has advanced one tenth cup pitch an interrupt is generated by the CPU #2, the drop point distance counter is incremented by one and a process called "apple dropping" is initiated. The interrupt also causes all index vectors to increment one location in each drop point memory segment.

With reference to the interrupt subroutine flow diagram for "apple dropping and classification" (FIG. 16), the process initiated by this last incrementing of all of the index pointers will be followed. At this position of the conveyor chains 34 the index pointers I1, I2 and I3 will be taken to be at memory locations m−2, n−6 and 4 respectively (FIG. 17). The subroutine of FIG. 16 is entered at point A in FIG. 15, and all of the index pointers are incremented by one memory location. CPU #2 then inquires as to whether the memory location m−2 for drop point one is non-zero. In this instance it is zero, i.e., no lane has an apple to be dropped (FIG. 17), so the answer is "no". Next an inquiry is made as to whether this is the last drop point. The answer is "no" again. Therefore the machine goes to the next drop point, which is drop point two, and asks if the data in the memory location n−6 is non-zero. "No" is the answer. Drop point two is not the last drop point on the machine so the memory segment corresponding to drop point three is queried for non-zero data at memory location 4. The memory is non-zero because the lane #1 bit has been set as shown. Therefore, the answer to the inquiry is "yes", and the apple is dropped in lane 1 at drop point three. As the process continues through all drop point memory segments, apples are dropped in all lanes where a non-zero value exists for the memory location to which the index pointer is directed. The indexed non-zero memory bits at each drop point are cleared after the signal is sent to cause the apples to be dropped.

The manner in which the aforementioned data from the memory locations is retrieved and utilized is as follows. The index pointers I1, I2 and I3 tell the processor CPU #2 where to "look" in the various memory segments to find data corresponding to the particular drop positions of the conveyor at that instant. The program instructions in ROM 118 associated with CPU #2 require, in this embodiment, that the data indexed at each memory segment be brought in sequence to an accumulator in CPU #2 during each one tenth cup pitch. The instructions further call for the data in the accumulator from each memory segment to be tested to see if it is non-zero. If the data is non-zero the instructions require that data be outputted to the address corresponding to the drop point memory segment from which it was obtained, i.e., the address of the index pointer addressing the data being retrieved. For example, with a non-zero determination such as will be made with the index pointer I3 positioned as shown in FIG. 17 for the memory segment assigned to drop point three, the CPU #2 outputs to the interface circuitry 111 (FIGS. 8 and 9) the eight bit binary number 00000001 as data, the five bits F, E, 8, 7 and 6 (FIG. 18) as the latch address and the six least significant bits of the binary coded hexadecimal (FIG. 18) as the drop point address.

After the last drop point memory location is reviewed by CPU #2, the microprocessor looks at the latest weight data received from multiport RAM 114 for lane number 1 (assuming the current interrupt pulse 122 is the first pulse 122 after the weight-transfer pulse 121). CPU #2 will have previously taken the new weights from the multiport RAM 114 upon the reception of a pulse 121. The operator has previously programmed the cut points for the apple sizing into the system via keyboard 108. CPU #2 investigates the cut point table and determines the class (size range) of the apple in lane 1. CPU #2 then investigates the delivery schedule, also programmed into the system by the operator, and determines the drop point for that class. The bit assigned to lane 1 for the calculated drop point (m−2 in this example if drop point one is to receive the sized apple) is then set. The least significant bit in the memory segment is assigned to lane 1 in this embodiment. The interrupt subroutine (FIG. 16) then terminates and the CPU #2 program (FIG. 15) is returned to the point where it was interrupted.

The flow diagram of FIG. 16 is repeated at the next interrupt pulse 122 wherein each of the memory segments is first interrogated to determine if there are apples to be dropped. Then, the new weight for lane number two is classified in the correct memory location in the correct drop point memory segment, and, since the index pointers ($I_1$, $I_2$, etc.) have now been shifted by one memory location it will be necessary to place the "one" bit one memory location back in the segment in order to assume that the apple in lane 2 will be dropped at the proper time. For example, if the apple in lane 2 were to be dropped at drop point three, the bit in lane 2 of memory location 4 would be set even though the index pointer $I_3$ would then be pointing at memory location 5 since (obviously) both the apples in lanes 1 and 2 would have to be dropped at the same time. Upon subsequent interrupt pulses, the foregoing process is repeated until the apples in each lane are classified and the proper memory segments incremented. Thereafter, the interrupt pulses merely serve to execute apple drops until the next pulse 121 is received to place new weight data in CPU #2. In other words, every one tenth cup pitch the machine looks at all of the drop point index pointers and drops whatever they are pointing to that is non-zero and, while there are still apples to be classified, classifies one apple in one lane (only) and increments or sets a corresponding bit in the correct memory segment corresponding to the operator programmed drop point.

With reference to FIG. 9 a block diagram is shown depicting the circuitry which receives the address information contained in the binary coded hexadecimal number identifying the drop point (FIG. 18) and the lane data obtained from the specific location in the memory segment which has been indexed as explained heretofore. FIG. 9 shows the interface circuitry 111 coupled to one solenoid driver 78. All of the other solenoid drivers 78 are similarly coupled to the interface circuitry and receive the same information from the interface circuitry simultaneously. The solenoids 87 for the various lanes are shown in FIG. 9 to be connected to a solenoid driver 137. The 500 pulse per cup pitch signal from output 102*b* of the drive chain encoder 102 is coupled to the interface circuitry 111 and is labeled "encoder index". The five bits from the binary coded hexadecimal 8000 address corresponding to places F, E, 8, 7 and 6 are coupled to the five "latch address" inputs to the address decoder 124. The address decoder also receives a "write" or timing command which is labeled "control" in FIG. 9. A latch 123 receives the six least significant bits of the binary coded hexadecimal number illustrated in FIG. 18 at six address terminals. The data from one memory location in one drop point memory segment is transmitted to four data terminals on the latch 123 corresponding to the four lanes of the conveyor 13. Each instance that an apple to be dropped is detected during one interrupt pulse interval, the address and data information for that drop point is sent to the interface circuitry 111, and the proper solenoid driver 78 will be actuated as will be described hereinafter.

The five-bit latch address number simply indicates that one of the drop points along the length of the conveyor 13 is being addressed and enables the latch 123 so that the addressed solenoid driver 78 will receive the data. The "write" command at the control terminal at the address decoder 124 is provided by CPU #2 to initiate the process. The enabling output of decoder 124 is coupled to the latch 123 to take the address and the data into the latch and present it on six address output lines and four data output lines respectively. The output lines from the latch are illustrated in FIG. 9 as single address and data output lines for the sake of convenience. Thus, a specific drop point is addressed by the six least significant bits of the binary coded hexadecimal number, and a specific lane is denoted by the data received in the 4-bit signal from CPU #2. By way of example, the six LSB address in FIG. 18 may indicate drop point 3, and the memory location number 4 (FIG. 17) indexed by pointer $I_3$ may indicate that the drop will be made in lane 1 at drop point 3.

When the enable signal is provided at the output of the address decoder 124 by virtue of a proper latch address and a "write" command from CPU #2, a first twelve microsecond one-shot device 128 is fired. On recovery of the one-shot device 128, a second twelve microsecond one-shot device 129 is fired. The output of the one-shot device 129 is coupled through a buffering inverter 131 to provide a delayed strobe signal output from the interface circuitry 111. The address and data lines from the latch 123 are buffered and inverted by buffering amplifiers 126 and 127 respectively before being presented at the output of the interface circuitry. The encoder index signal (500 pulses per cup pitch) is also buffered and inverted by buffer amplifier 132 to provide the index signal output from the interface circuitry. The inversion of the interface outputs are merely for the purpose of presenting the output signals therefrom in a convenient form for the solenoid driver circuits 78.

As mentioned hereinbefore all of the downstream discharge station solenoid driver controls 78 receive the address, data, strobe and 500 pulse per cup pitch encoder index pulses simultaneously. Each of the discharge station control units includes a group of eight manually setable address switches 135 (FIG. 9). An address decoder 133 receives the manually set address information as well as the six lines of address information from the interface circuitry 111. When the address from the interface matches the manually selected address an enable signal is provided by the address decoder 133 to a data latch 134 and to a timer 136 which is enabled to receive the strobe signal. The leading edge of the strobe signal resets the timer 136 and removes the reset from the data latch 134. On the trailing edge of the strobe signal the data on the data lines (lane drop information) to the data latch 134 are latched into the data latch outputs and the timer begins to count 256 index counts (slightly over ½ cup pitch) from the encoder index pulses. A solenoid driver circuit 137 is energized by the output from data latch 134 so that the various solenoids 87 for each lane at the drop point will be actuated. If, for example, the solenoid driver 78 shown in FIG. 9 is at discharge station three and the address and data information for the current interrupt pulse are as seen in FIGS. 17 and 18, then the solenoid 87 for lane 1 is actuated and the apple in lane 1 will be dropped onto the underlying takeaway conveyor 41. After the timer has received 256 encoder index pulses a timer output signal is generated and further counts are blocked. The data latch 134 is reset by the timer output signal, and the drive information at the output of the data latch 134 is removed.

The aforedescribed components in the control portion of the system disclosed herein are readily commercially available and will be recognizable by those skilled in this art. The central processing unit #1 (112) is properly represented by a *MOTOROLA MC6802L, and the central processing unit #2 (116) is properly represented by an *INTEL 80/20-4.

*TRADEMARK

Figure 11:
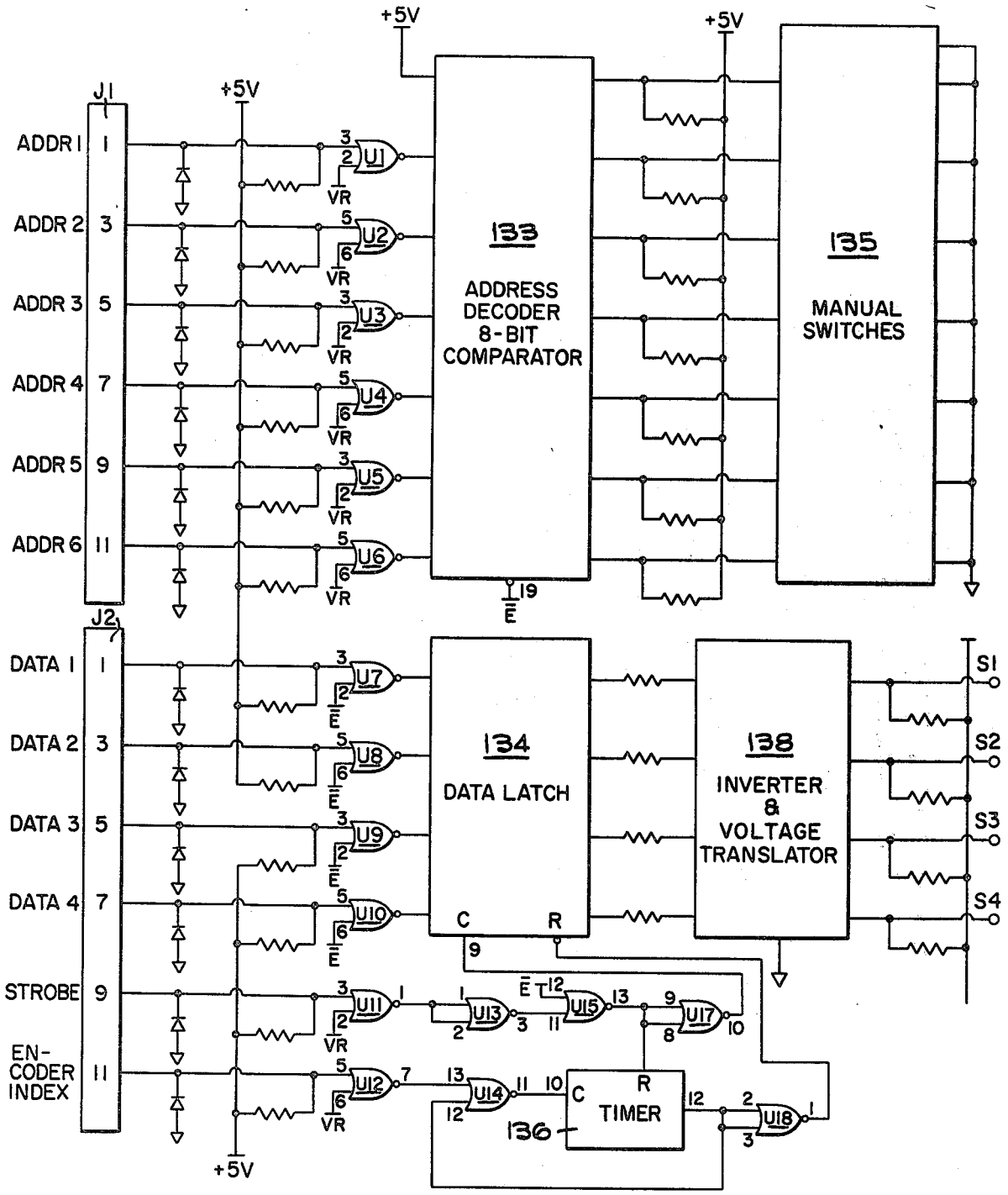
FIG. 11 is an electrical schematic diagram of a portion of the circuitry in one of the rotary solenoid drivers.
Figure 12:
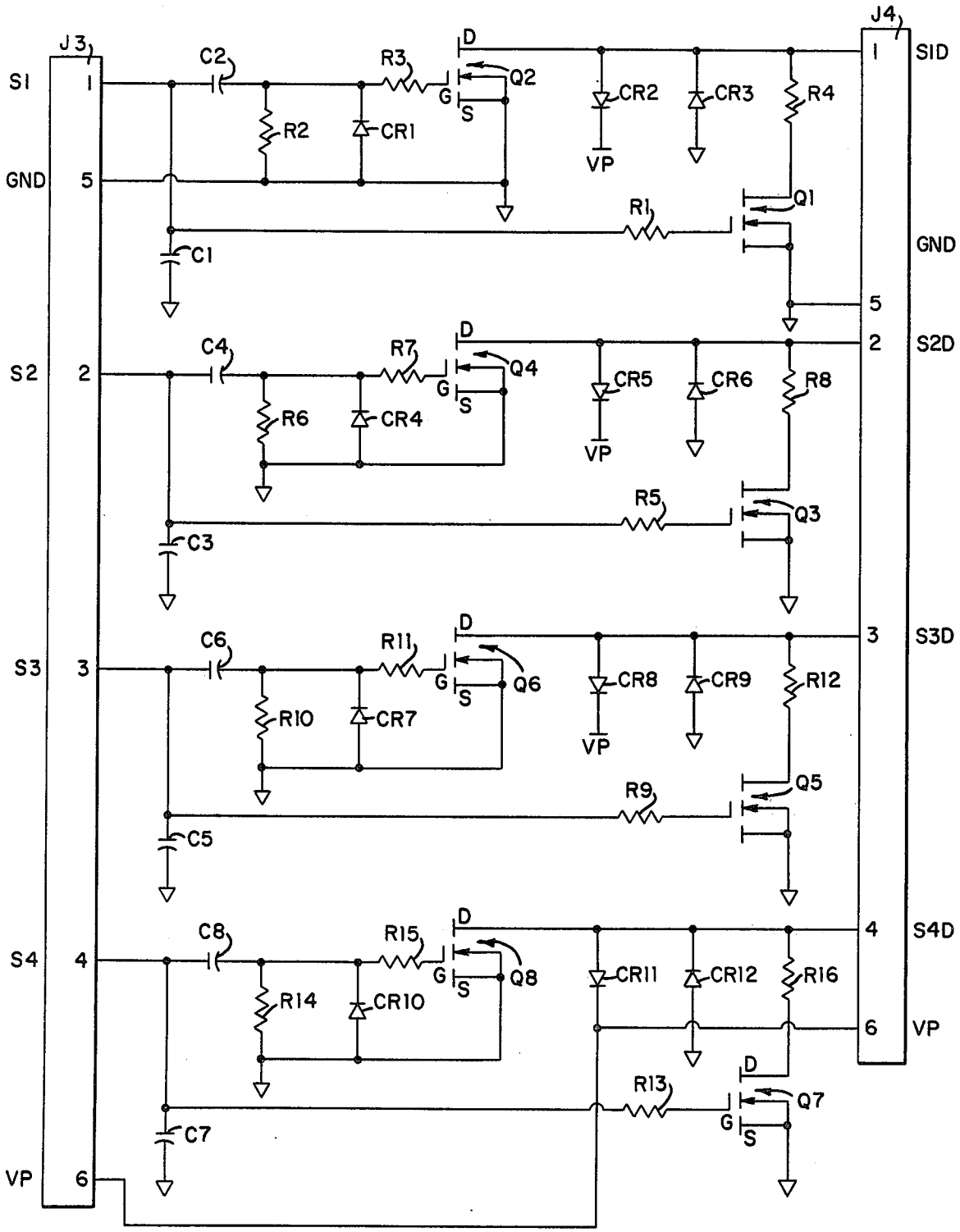
FIG. 12 is an electrical schematic diagram of the specific circuitry for the driver in one of the rotary solenoid drivers.
Figure 11:
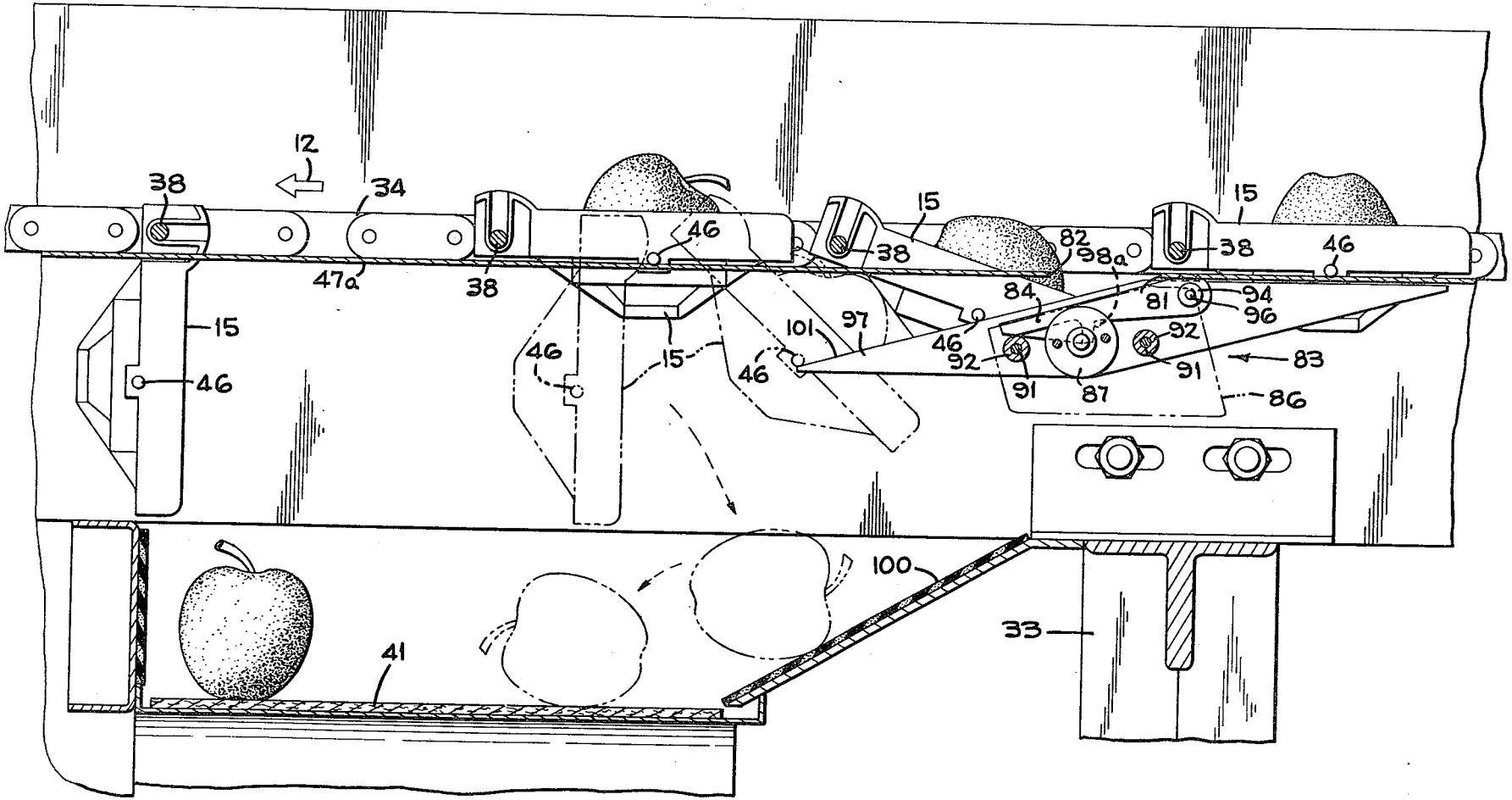

The details of one of the rotary solenoid driver control circuits 78 described generally hereinbefore may be seen by reference to FIGS. 11 and 12 where signal inversion is ignored to enhance clarity. A terminal J1 in FIG. 11 receives the six address inputs in the binary coded hexadecimal number of FIG. 18 (identifying the proper drop station) seen as address 1 through address 6. Another terminal J2 has coupled thereto the four data inputs from one of the memory segments (FIG. 17) at terminals marked data 1 through data 4. The strobe input and the encoder index input are also shown on terminal J2. The address inputs are coupled through buffering NOR gates U1 through U6 to one set of inputs on the address decoder 133 which is a comparator. Another set of inputs on the comparator is coupled to the manual address switches 135 which are preset to recognize the particular address of the drop station at which the solenoid driver control circuit 78 is located. When an address is presented through the NOR gates U1–U6 which matches the preset address, the comparator 133 provides the enable output signal shown as E. It should be noted that when a specified one of the manually setable switches is set in the off condition the switch setting prevents any match in the comparator and, therefore, prevents the occurence of the enabling signal E. This switch position is used when the particular drop station is desired to be inactivated (for maintenance purposes for example).

The data 1 through data 4 outputs are coupled through buffering NOR gates U7 through U10 (FIG. 11) to the input side of the data latch 134. The levels at the address and data inputs (when apples are to be dropped) are presented to each of the solenoid driver control circuits 78 as previously explained. When an address match is obtained and an enabling signal is provided from the comparator 133, the NOR gate U15 (FIG. 11) is enabled. Thus, when the low going leading edge of the strobe signal arrives at terminal J2, pin 9, NOR gate U11 produces a high output which is coupled through NOR gate U13 to produce a low output therefrom. The low output from U13 and the low enabling signal E cause NOR gate U15 to produce a high output to the reset terminal of the timer 136. The output at pin 12 of the timer 136 goes to a low state when it is reset which provides a high state signal at the output of NOR gate U18 which may be seen coupled to the reset input of the data latch 134. The high state signal at the reset of the data latch removes the reset therefrom and places it in condition to accept data. When the trailing (rising) edge of the strobe signal occurs, the NOR gate U11 produces a low state output which is coupled through NOR gate U13 producing a high state output therefrom. The high and low state outputs at the input of NOR gate U15 then provide a low state output which is coupled through NOR gate U17 to produce a high state output therefrom. The high output from NOR gate U17 is coupled to the data latch 134 causing the data on the data lines 1 through 4 at the outputs of the NOR gates U7–U10 to be latched into the data outputs from the data latch. The timer 136 then begins to count the encoder index pulses until it reaches 256 counts. At that point the output at pin 12 of the timer goes to a high state which is coupled through NOR gate U18 driving the output thereof to a low state. The low signal from the output of NOR gate U18 is coupled to the reset input of the data latch 134 thereby resetting the latch and removing the solenoid drive information at the latch outputs, thus allowing the solenoids 87 to be released. The high output at pin 12 of timer 136 is also coupled to one input of the NOR gate U14 so that the next low going encoder index pulse drives the output of U14 low. The output of the NOR gate U14 stays low despite the change in state on one input thereof, thereby blocking the subsequent pulses to the timer 136. An inverter and voltae translator 138 is shown receiving outputs from the data latch 134 to invert them and expand them to assume either a ground level or a 10 volt level (where solenoid 87 is to be activated). The data latch outputs are therefore only present at the output terminals S1 through S4 during that period within which 256 encoder index pulses are counted by the timer 136.

In FIG. 12 the driver circuit 137 for the four solenoids 87 located at each drop station is shown. As pointed out, each input S1–S4 receives either a ground signal or a 10-volt signal at pins 1 through 4 on terminal J3. Each of the four channels in the driver circuit 137 is the same. The signal development between terminal 1 on input terminal J3 and terminal 1 on output terminal J4 for the conversion of the drive signal S1 to the solenoid drive signal S1D will be discussed as exemplary of the signal processing for the other channels in the driver circuit as well. When the signal S1 assumes a 10-volt level at pin 1 of input terminal J3, it is presented to a differentiating circuit comprised of capacitor C2 and resistor R2. At the positive edge of the 10-volt signal the left side (FIG. 12) of capacitor C2 has a voltage thereon which is equal in amplitude to the voltage at the upper end of the resistor R2. This level is approximately 10 volts. As capacitor C2 charges, the current through resistor R2 diminishes and the voltage across the resistor R2 decreases. A pair of field effect power transistors Q1 and Q2 function as voltage controlled current switches being primarily voltage sensitive and having a low current drain. A high voltage at the gate of the field effect power transistor Q2 causes conduction between the drain and source thereon. Therefore, the field effect transistor Q2 conducts at a saturation level immediately upon application of 10 volts at J3, pin 1. Q2 conducts over one ampere, in this instance, until the voltage across resistor R2 falls to a level which turns Q2 off. The current is drawn through the rotary solenoid 87 which is connected to pin 1 of the output terminal J4. The R2–C2 combination is such that this high current conduction level through the solenoid coil persists for about 30 milliseconds until capacitor C2 charges and transistor Q2 is turned off when the gate voltage falls below a certain level.

The signal which causes Q2 to initially conduct to saturation also turns on field effect power transistor Q1 at a much lower level because of the lower gate voltage level provided by the biasing components C1 and R1 in the gate circuit of Q1. Q1 therefore continuously conducts at about 0.2 amperes as long as the 10-volt signal S1 is applied to terminal 1 of the input terminal J3. A supply voltage VP is shown connected through input terminals J3 to each of the solenoid driver circuits. Each of the four rotary solenoids 87 at a drop station is connected between a respective terminal 1–4 on output terminal J4 and the supply VP. The diodes in the drain circuits of the field effect power transistors serve to suppress inductive transients generated by the solenoids.

The gate members 84 at a drop station (FIG. 13) are preferably molded from a plastic material such as *Delrin or nylon so that they are low mass parts. Since the rotary solenoids 87 selected for this application are readily actuated in within 50 to 60 milliseconds at about 0.2 amperes and since a high initial current level to a solenoid is assured by the circuit described herein, the low mass gate members 84 are readily lowered (as shown in FIG. 7) by the disclosed drive circuit 78 well within one-half cup pitch (100 milliseconds) at the aforementioned conveyor speed. It is essential to the high speed weight sizing performed by the system described herein that the gate assemblies be actuated for only about one-half cup pitch at speeds of 300 to 500 cups per minute and that the gate members 84 be returned to a bridging position before the subsequent cup arrives, so that the gate may bridge the rail opening if the subsequent cup is to remain in its upright apple supporting position.

*TRADEMARK

Although the best mode contemplated for carrying out the present invention has been herein shown and described, it will be apparent that modification and variation may be made without departing from what is regarded to be the subject matter of the invention.

What is claimed is:

1. In combination with apparatus for sorting articles in accordance with a plurality of predetermined physical characteristic ranges wherein a conveyor is provided for transporting the articles from a first point where the characteristic is measured to a plurality of second points each corresponding to one of the predetermined ranges where the articles are removed from the conveyor in response to an appropriate signal transmitted thereto, the improvement comprising a memory segment assigned to each one of said plurality of second points, a predetermined number of memory locations in each said memory segments dependent upon the distance along the conveyor from the first point to the corresponding one of the plurality of second points, said memory locations operating to receive and store digital data indicative of the physical characteristic range assigned to the corresponding second point, means associated with each memory segment for indexing each of said memory locations in sequence, means for testing the data at each indexed memory location for stored digital data indicative of the measured physical characteristic, means for synchronizing said means for indexing with the conveyor movement, means for outputting the stored data to the one of the second points corresponding to the indexed memory location when digital data indicative of the physical characteristic is stored therein, whereby articles having physical characteristics in the one of said plurality of predetermined ranges assigned thererto are removed at the corresponding second point, and means for measuring the distance between the first point and the corresponding one of the plurality of second points in terms of conveyor length and for altering said predetermined number of memory locations when the measured conveyor length changes by more than a predetermined distance.

2. Apparatus for sorting articles within a plurality of physical characteristic ranges, comprising a multilane conveyor for transporting the articles, means attached to the conveyor for measuring the article characteristic and for providing a measurement output, a plurality of downstream discharge stations on the conveyor at each of which articles in a predetermined range may be discharged, a conveyor position encoder providing a conveyor position output, a memory segment assigned to each discharge station, a plurality of memory locations in each memory segment wherein the number of locations is dependent upon the distance from the means for measuring to the corresponding one of the discharge stations and wherein a distinct portion of each memory location is assigned to each lane of the multilane conveyor, means for receiving the measurement output and for entering data indicative of the measured characteristic of the article into one portion of one memory location in the memory segment assigned to a particular discharge station, means for inspecting each of said memory locations in sequence in each memory segment in synchronism with said conveyor position output so that data entered into said one memory location is retrieved after said conveyor moves substantially the distance from said means for measuring to said particular discharge station, and means for discharging articles from the conveyor located at each discharge station, said last named means being responsive to said retrieved data, whereby the article is discharged at said particular discharge station.

3. Apparatus as in claim 2 together with means coupled to said conveyor position output for sensing change in conveyor length from the means for measuring to each discharge station and for making a corresponding change in the number of memory locations in each memory segment when conveyor length change exceeds a predetermined mined amount.

4. In combination with apparatus for sorting articles in accordance with ones of a plurality of value ranges for a particular physical characteristic wherein a conveyor provides transport for articles from a first point to a plurality of second points, and wherein the physical characteristic is measured at the first point and the articles are removed from the conveyor at one of the plurality of second points corresponding to a predetermined one of the value ranges, the improvement comprising means located proximate to said first point for providing a reference output signal indicative of the position of said first point, means located proximate to each of said plurality of second points for providing separate drop point output signals indicative of the position of separate ones of said plurality of second points, means coupled to said reference and drop point output signals for storing the distance between said first point and separate ones of said second points in terms of conveyor length increments, and means for altering said stored distance when the conveyor changes length by more than a predetermined amount.

5. The combination of claim 4 wherein said means for storing comprises a memory segment assigned to each one of said plurality of second points, a predetermined number of memory locations in each of said memory segments corresponding to the number of conveyor increments between the first point and each of said plurality of second points, and wherein said means for altering said stored distance comprises means for changing said predetermined number of memory locations.

6. The combination of claim 5 wherein data stored in said memory locations is indicative of the value range assigned to the corresponding one of said plurality of second points, together with means for sequentially indexing said memory locations in each of said memory segments and for detecting stored data therein, and means for synchronizing said means for indexing with conveyor movement.

7. In combination with apparatus for sorting articles in accordance with ones of a plurality of value ranges for a particular physical characteristic wherein a conveyor provides transport for articles from a first point to a plurality of second points, and wherein the physical characteristic is measured at the first point and the articles are removed from the conveyor at one of the plurality of second points corresponding to a predetermined one of the value ranges, the improvement comprising means attached to the conveyor for providing a conveyor reference position, means located proximate to the first point and cooperating with said means attached to the conveyor for providing a first output signal, means located proximate to each of the plurality of second points and cooperating with said means attached to the conveyor for each providing a second output signal indicative of the position of respective ones of said plurality of second points, means coupled to said first and second signals for calculating and storing indications of the lengths of the conveyor reaches between the first point and each of the plurality of second points, and means for altering said stored length indications when the conveyor length changes by more than a predetermined amount.

8. The combination of claim 7 wherein said means for storing comprises a memory segment assigned to each one of said plurality of second points, a predetermined number of memory locations in each of said memory segments corresponding to the stored length of conveyor reaches between the first point and each of said plurality of second points, and wherein said means for altering said stored length indications comprises means for changing said predetermined number of memory locations.

9. The combination of claim 8 wherein data stored in said memory locations is indicative of the value range assigned to the corresponding one of said plurality of second points, together with means for sequentially indexing said memory locations in each of said memory segments and for detecting stored data therein, and means for synchronizing said means for indexing with conveyor movement.

* * * * *